US006047508A

United States Patent [19]

Goodman et al.

[11] Patent Number: 6,047,508

[45] Date of Patent: Apr. 11, 2000

[54] WALL PANEL PARTITION SYSTEM

[75] Inventors: Steven F. Goodman, Wyoming; Roy W. Fink, Portage; James D. Houda, Grand Rapids; Michael H. Abson, Lowell; Allen C. Hager, Grand Rapids, all of Mich.

[73] Assignee: Steelcase Development Inc., Grand Rapids, Mich.

[21] Appl. No.: 09/038,371

[22] Filed: Mar. 10, 1998

[51] Int. Cl.[7] ..... E04H 1/00

[52] U.S. Cl. ..... 52/241; 52/238.1; 52/242; 52/243.1; 52/220.7; 52/481.2; 52/783.18; 52/783.19; 52/584.1

[58] Field of Search ..... 52/238.1, 239, 52/241, 242, 243, 243.1, 220.7, 481.2, 783.17, 783.18, 783.19, 783.11, 797.1, 798.1, 801.1, 801.11, 580, 582.1, 584.1

[56] References Cited

U.S. PATENT DOCUMENTS

| | | | |
|---|---|---|---|
| 1,724,821 | 8/1929 | Bohnsack . | |
| 1,990,259 | 2/1935 | Walters . | |
| 2,064,683 | 12/1936 | Olsen . | |
| 2,296,782 | 2/1942 | Fischer et al. . | |
| 2,315,687 | 4/1943 | Burke | 52/241 X |
| 2,558,428 | 6/1951 | Fuller et al. | 52/241 X |
| 2,621,763 | 12/1952 | Buqour et al. | 52/481.1 |
| 2,991,855 | 7/1961 | Buell et al. . | |
| 3,037,593 | 6/1962 | Webster . | |
| 3,324,617 | 6/1967 | Knight et al. . | |
| 3,349,535 | 10/1967 | Balinski . | |
| 3,378,977 | 4/1968 | Vervoet . | |
| 3,425,568 | 2/1969 | Albright . | |
| 3,514,883 | 6/1970 | Albright . | |
| 3,537,217 | 11/1970 | Lickliter et al. . | |
| 3,633,327 | 1/1972 | Klingensmith et al. . | |
| 3,740,912 | 6/1973 | Sauer et al. . | |
| 3,755,979 | 9/1973 | Pantazi . | |
| 3,802,146 | 4/1974 | Tacke et al. . | |

FOREIGN PATENT DOCUMENTS

| | | | |
|---|---|---|---|
| 1188259 | 3/1965 | Germany | 52/239 |

OTHER PUBLICATIONS

Exhibit A is a brochure entitled *Knoll—Hannah Desk System*, 18 pages, dated Oct. 1986.

Exhibit B is a brochure entitled *Knoll—Hannah Desk System*, 13 Pages, undated but published in 1986.

Exhibit C is a publication entitled *Knoll—Hannah Desk System—Electrical Assembly Guide*, (12 pages), undated but published in 1986.

Exhibit D is a publication entitled *Knoll—Hannah Desk System—Assembly Guide*, 12 pages, undated but published in 1986.

Exhibit A is an article entitled *Stow & Davis Elective Elements Cable Mangement Panel Installation SPB89*.

Exhibit B is an article entitled *Steelcase Elective Elements Cable Management Panel SPB89*.

Exhibit C is an article entitled *Steelcase Installation Directions for Adding Grommet Holes to Standard Elective Elements Surface*.

*Primary Examiner*—Laura A. Callo
*Attorney, Agent, or Firm*—Price, Heneveld, Cooper, DeWitt & Litton

[57] ABSTRACT

A reconfigurable office partition includes a movable panel with a rigid frame, a core panel mounted therein, and at least one cover panel detachably mounted on the frame and enclosing an associated portion thereof. The frame has at least one vertical stile with first and second channels that extend longitudinally therealong and are shaped to receive utilities therein through outwardly opening sides. The outwardly opening sides of the channels are juxtaposed in opposite directions to facilitate routing utilities along both faces of the panel. A variable height frame support may be positioned between the top of the panel and the building ceiling for floor-to-ceiling applications.

(List continued on next page.)

66 Claims, 20 Drawing Sheets

U.S. PATENT DOCUMENTS

| | | | |
|---|---|---|---|
| 3,839,839 | 10/1974 | Tillisch et al. . | |
| 3,872,639 | 3/1975 | Crumbaugh et al. . | |
| 3,921,346 | 11/1975 | Sauer et al. . | |
| 3,940,899 | 3/1976 | Balinski . | |
| 3,943,680 | 3/1976 | Balinski . | |
| 3,974,607 | 8/1976 | Balinski . | |
| 4,010,591 | 3/1977 | Gross . | |
| 4,037,379 | 7/1977 | Ozanne | 52/783.17 X |
| 4,129,163 | 12/1978 | Johnson | 52/239 X |
| 4,185,422 | 1/1980 | Radek . | |
| 4,231,205 | 11/1980 | Wendt . | |
| 4,270,748 | 6/1981 | Ray . | |
| 4,324,078 | 4/1982 | Gray . | |
| 4,353,192 | 10/1982 | Pearson et al. . | |
| 4,364,212 | 12/1982 | Pearson et al. . | |
| 4,413,458 | 11/1983 | Ting . | |
| 4,434,596 | 3/1984 | McAteer et al. . | |
| 4,535,577 | 8/1985 | Tenser et al. . | |
| 4,578,832 | 4/1986 | Primucci . | |
| 4,619,486 | 10/1986 | Hannah et al. . | |
| 4,757,657 | 7/1988 | Mitchell et al. . | |
| 4,866,899 | 9/1989 | Houser . | |
| 4,883,330 | 11/1989 | Armstrong et al. . | |
| 5,038,534 | 8/1991 | Pollock . | |
| 5,038,539 | 8/1991 | Kelley et al. . | |
| 5,062,246 | 11/1991 | Sykes . | |
| 5,090,170 | 2/1992 | Propst . | |
| 5,117,599 | 6/1992 | Voss . | |
| 5,134,826 | 8/1992 | LaRoche et al. . | |
| 5,140,792 | 8/1992 | Daw et al. . | |
| 5,152,113 | 10/1992 | Guddas . | |
| 5,165,213 | 11/1992 | Finch et al. . | |
| 5,341,615 | 8/1994 | Hodges et al. . | |
| 5,377,466 | 1/1995 | Insalaco et al. . | |
| 5,394,668 | 3/1995 | Lim . | |
| 5,433,046 | 7/1995 | MacQuarrie et al. . | |
| 5,481,834 | 1/1996 | Kowalczyk et al. . | |
| 5,490,357 | 2/1996 | Lin . | |
| 5,657,601 | 8/1997 | Bean et al. | 52/426 |
| 5,675,949 | 10/1997 | Forslund et al. . | |
| 5,704,509 | 1/1998 | Rosenkrantz . | |
| 5,855,100 | 1/1999 | Hsuch | 52/481.2 |

XI
XVI
III
III
3
4
6
7
8
9
14
15
16
17
18
23
24
25
26
27
30
31
32
33
40
41
42

8
24
4
23
14
40
6
42
9
26
15
27
3
7
16
XVII
41
17
18
31
33
30
VIII
34

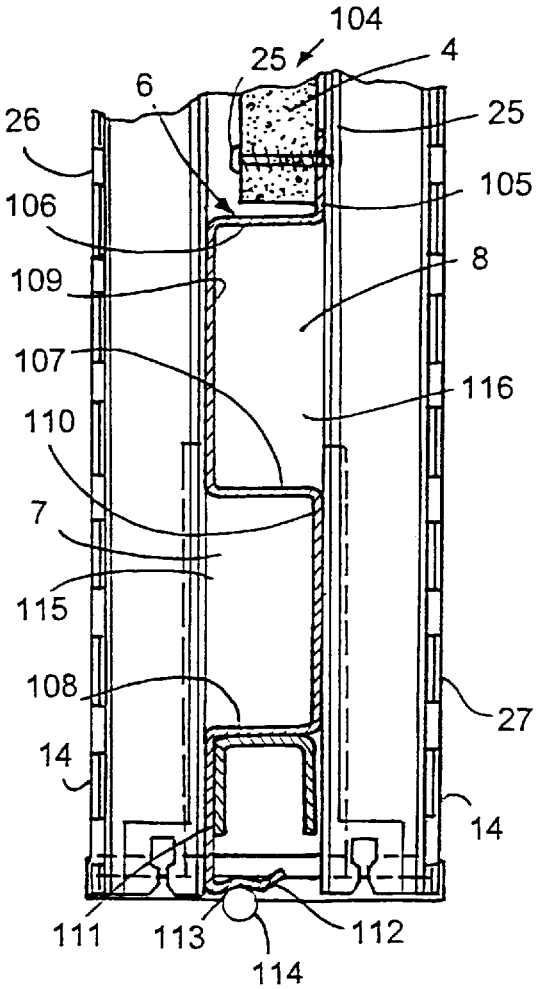
Fig. 14
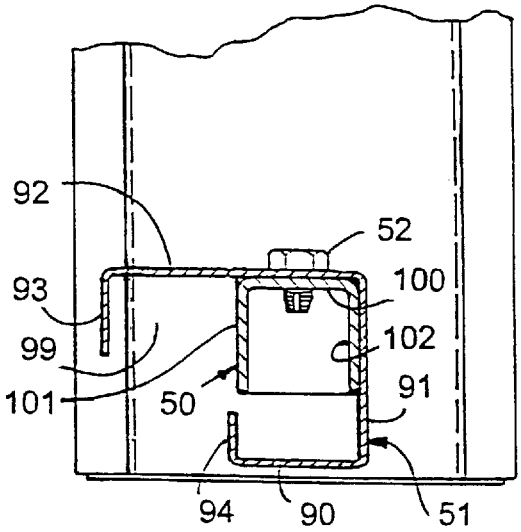
Fig. 13
Fig. 12
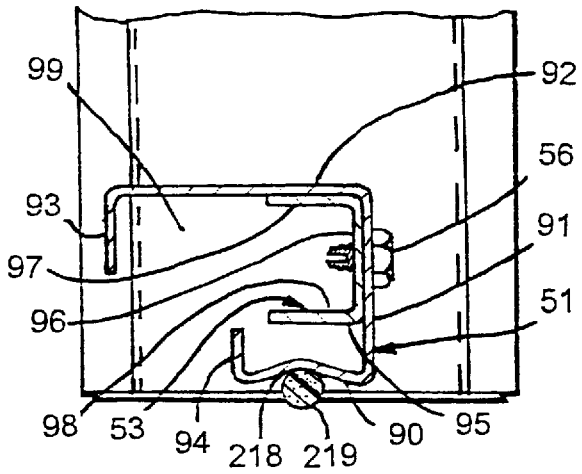

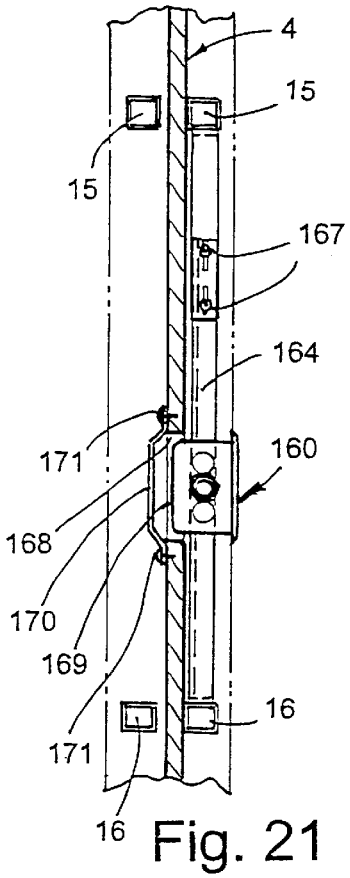
Fig. 21
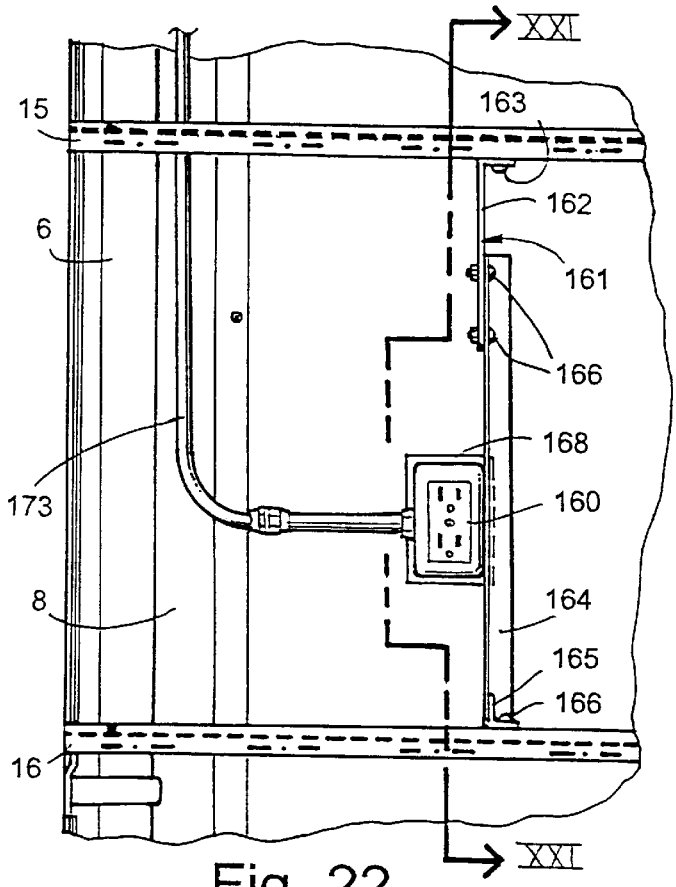
Fig. 22
Fig. 23
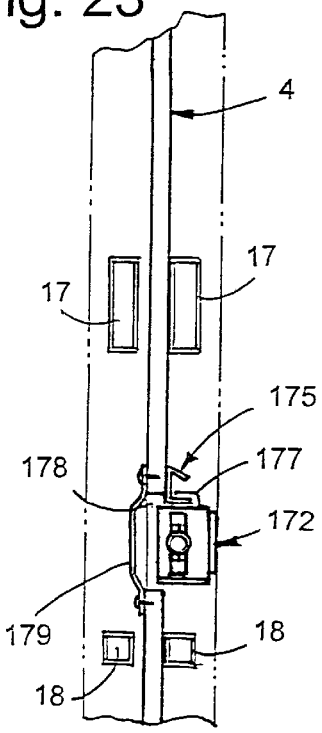
Fig. 24
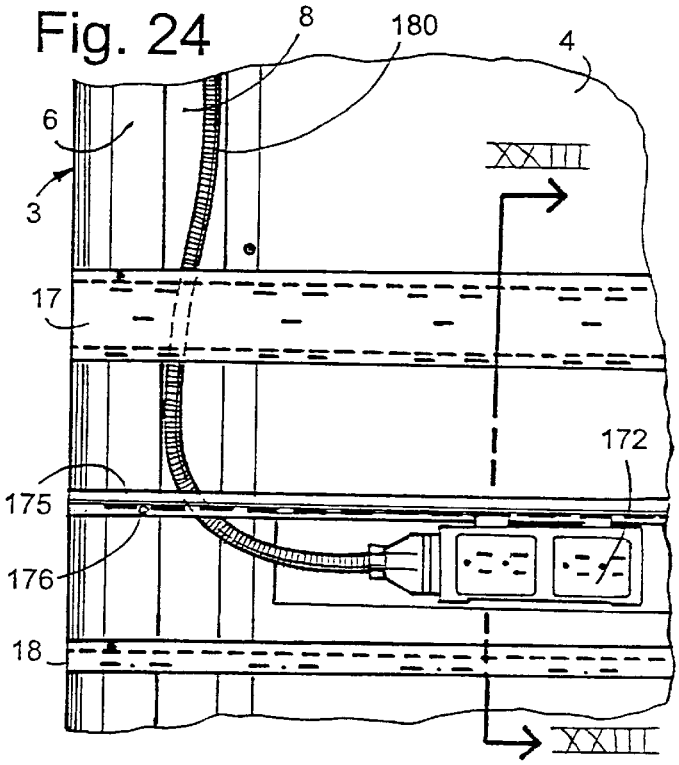

Fig. 35
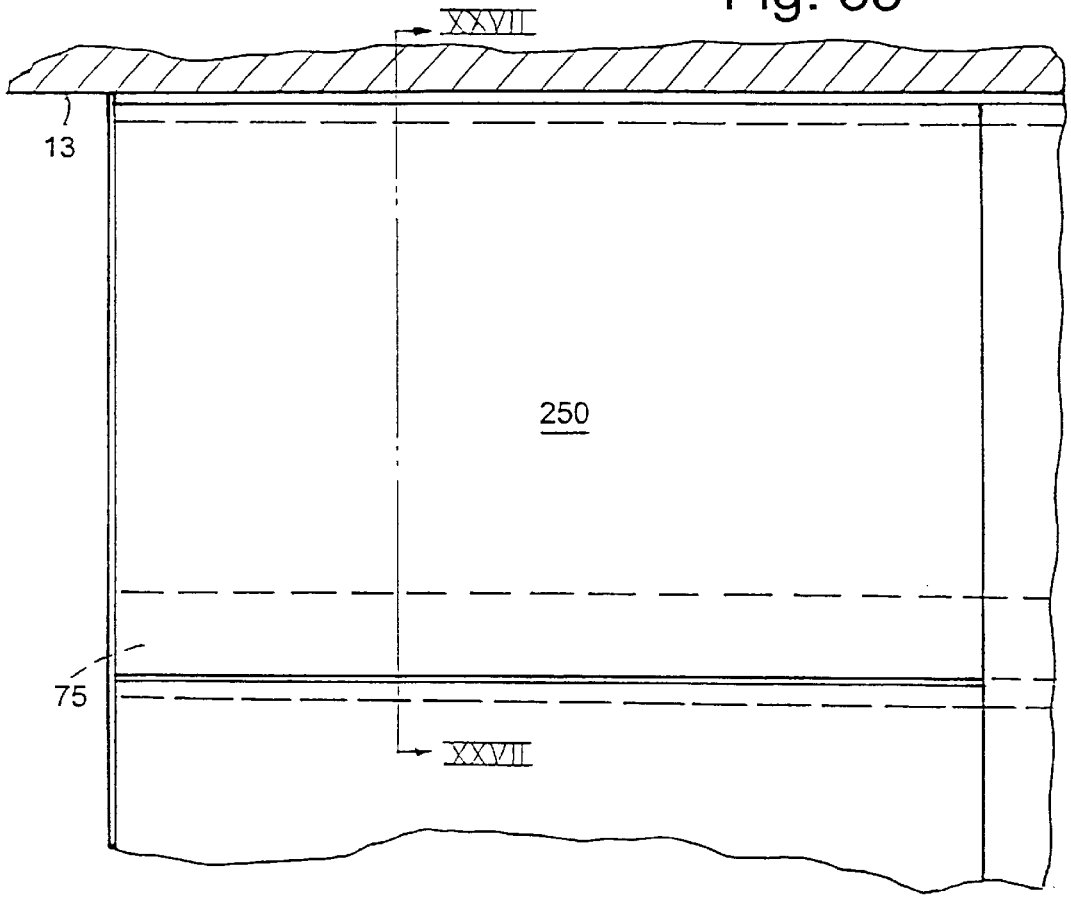
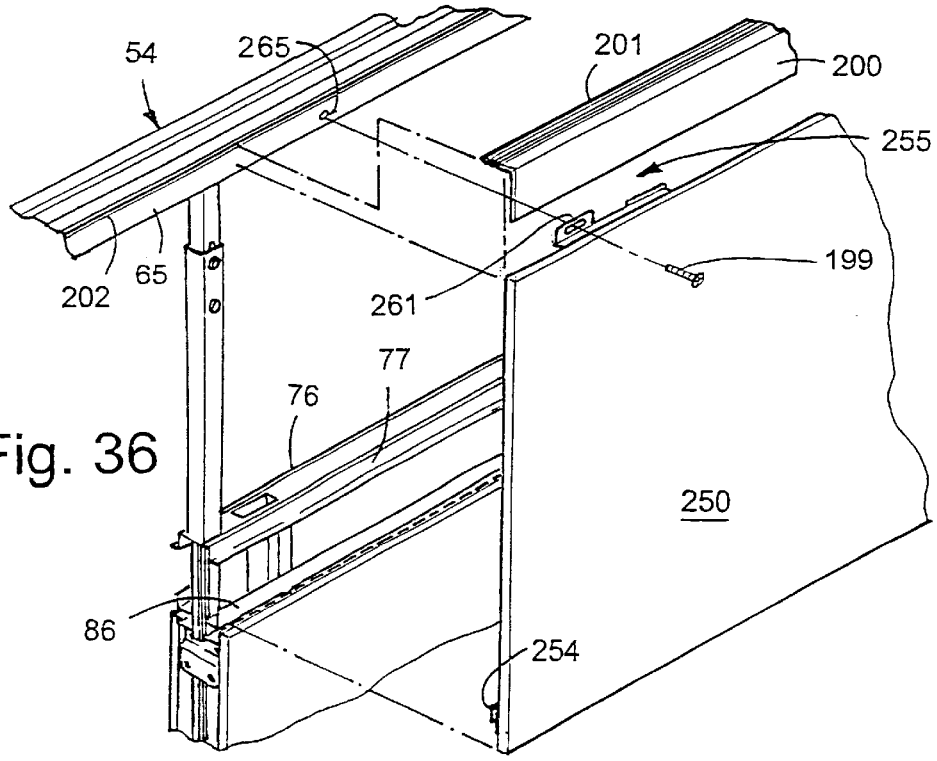
Fig. 36

54
250
21
14
270
271
270
4
270
270
269
6
5
3
139
139
266
266
270
271
270
139
136
5
267
270
33
270
266
30
266
266

Fig. 38
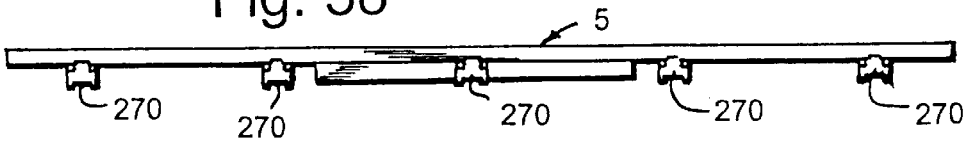
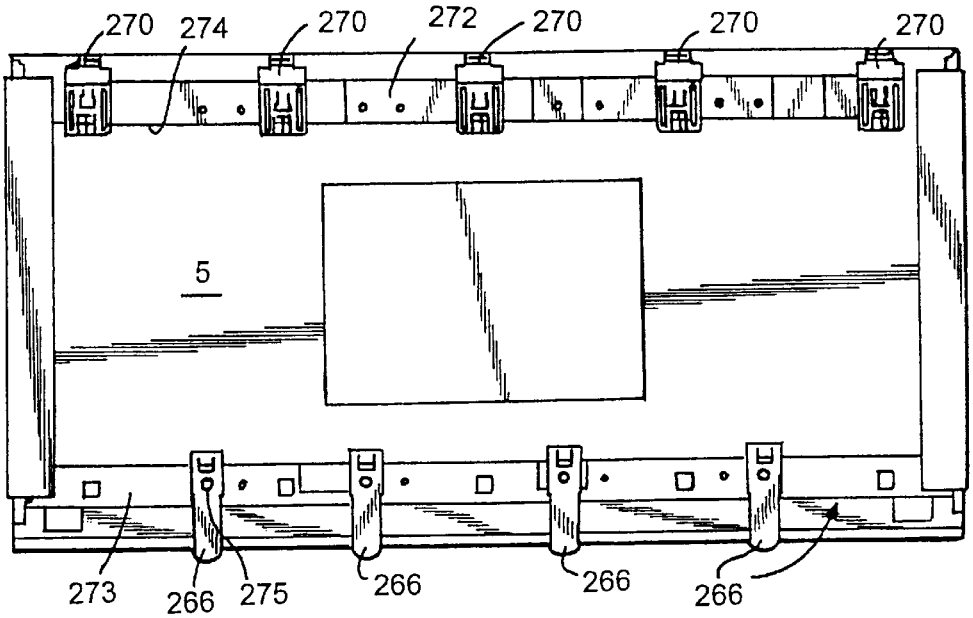
Fig. 39
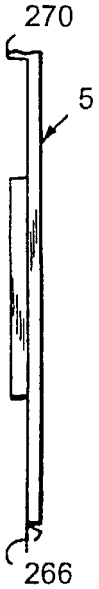
Fig. 40
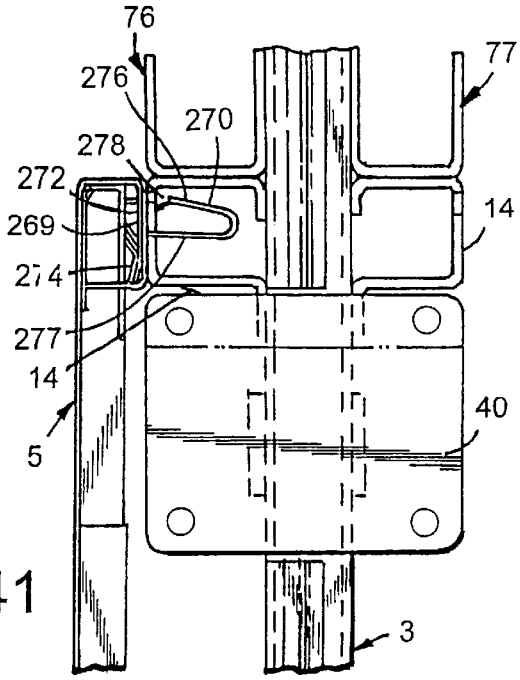
Fig. 41

WALL PANEL PARTITION SYSTEM

CROSS-REFERENCES TO RELATED APPLICATIONS

The present application is related to the following, commonly assigned, co-pending U.S. patent applications, which are hereby incorporated herein by reference.

| Appln. No. and status | Filing Date | Title |
|---|---|---|
| 09/037,476, pending | 3/10/98 | CLEAR WALL PANEL SYSTEM |
| 09/037,840, pending | 3/10/98 | VARIABLE WIDTH END PANEL |
| 09/037,478, pending | 3/10/98 | ADJUSTABLE DOORWAY STRUCTURE |
| 09/038,370, pending | 3/10/98 | OVERHEAD STRUCTURES FOR FOR WALL SYSTEM |
| 09/005,428, pending | January 9, 1998 | PARTITION SYSTEM WITH REMOVABLE COVER PANELS |
| 08/367,804, now U.S. Pat. No. 5,784,843 | December 30, 1994 | INTEGRATED PREFABRICATED FURNITURE SYSTEM FOR FITTING-OUT OPEN PLAN BUILDING SPACE |
| 08/579,614, now U.S. Pat. No. 5,746,035 | December 26, 1995 | PARTITION SYSTEM |

BACKGROUND OF THE INVENTION

The present invention relates to the finishing or fitting-out of building space and the like of the type having a generally open plan interior, and in particular to an integrated prefabricated partition system that includes movable frames with vertical utility channels.

The finishing or fitting-out of building spaces for offices, medical treatment facilities, and other areas where work is conducted has become a very important aspect of effective space planning and layout. Work patterns, technology, and business organizations are constantly evolving and changing. The building space users require products which facilitate change at lower cost, yet provide the privacy and aesthetic advantages of permanent floor-to-ceiling architectural wall systems. Space planning is no longer a static problem. Changing technology and changing work processes demand that a design and installation be able to support and anticipate change.

These space planning challenges are driven largely by the fact that modern office spaces are becoming increasingly more complicated and sophisticated due to increasing needs of the users for improved utilities support at each workstation or work setting. These "utilities," as the term is used herein, encompass all types of resources that may be used to support or service a worker, such as communications and data used with computers and other types of data processors, telecommunications, electronic displays, etc., electrical power, conditioned water, and physical accommodations, such as lighting, HVAC, sprinklers, security, sound masking, and the like. For example, modern offices for highly skilled "knowledge workers" such as engineers, accountants, stock brokers, computer programmers, etc., are typically provided with multiple pieces of very specialized computer and communications equipment that are capable of processing information from numerous local and remote data resources to assist in solving complex problems. Such equipment has very stringent power and signal requirements, and must quickly and efficiently interface with related equipment at both adjacent and remote locations. Work areas with readily controllable lighting, HVAC, sound masking, and other physical support systems, are also highly desirable to maximize worker creativity and productivity. Many other types of high technology equipment and facilities are also presently being developed which will need to be accommodated in the work places of the future.

The efficient use of building floor space is also an ever-growing concern, particularly as building costs continue to escalate. Open office plans have been developed to reduce overall office costs, and generally incorporate large, open floor spaces in buildings that are equipped with modular furniture systems, which are readily reconfigurable to accommodate the ever-changing needs of a specific user, as well as the divergent requirements of different tenants. One arrangement commonly used for furniture open plans includes movable partial height partition panels that are detachably interconnected to partition off the open spaces into individual work settings and/or offices. Such partial height partition panels are configured to receive hang-on furniture units, such as worksurfaces, overhead cabinets, shelves, etc., and are generally known in the office furniture industry as "systems furniture." Another arrangement for dividing and/or partitioning open plans involves the use of modular furniture, in which a plurality of differently shaped, complementary free-standing furniture units are positioned in a side-by-side relationship, with upstanding partial height privacy screens available to attach to selected furniture units to create individual, distinct work settings and/or offices. All of these types of modular furniture systems have been widely received due largely to their ability to be readily reconfigured and/or moved to a new site, since they are not part of a permanent leasehold improvement.

In order to gain increased efficiency in the use of expensive office real estate, attempts are now being made to try to support highly paid knowledge workers with these types of modular furniture systems in open office settings, instead of conventional private offices. However, in order to insure peak efficiency of such knowledge workers, the work settings must be equipped with the various state-of-the-art utilities and facilities discussed above. Since such work settings must be readily reconfigurable to effectively meet the ever-changing needs of the users, the distribution and control of utilities throughout a comprehensive open office plan has emerged as a major challenge to the office furniture industry. The inherent nature of modular furniture systems, which permits them to be readily reconfigurable into different arrangements, makes it very difficult to achieve adequate utility distribution and control.

Today's office workers need new flexible alternative products for the creation of individual and collaborative spaces which allow the expression of the cultural aims of the organization, express the creativity of the designer, provide a "sense of place" for the users, and provide a competitive edge for the developer. These needs include a full range of privacy options, from fully enclosed offices which support individual creative work to open spaces for collaborative team work. The products must also be able to accommodate diverse organizations, unique design signatures, and constantly changing work processes. Workers also need effective lighting, better air quality, life safety, and ergonomic task support to promote productivity, minimize the expenses of absenteeism and workman's compensation, and reduce potential liability.

Hence, utility distribution and control are fast becoming one of the major issues in office fit-out and furniture.

Changing technology is creating greater demands on power and signal distribution networks. As businesses become more aware of the impact of proper ventilation and climate control on employee health and performance, HVAC is becoming more important as well. The current disposition of HVAC, lighting, and fire protection in the ceiling creates a separation between these services and the work settings below leading to inefficient and inaccurate systems. Routing power and signal distribution below the floor or in furniture systems often ends up in complex idiosyncratic systems which are difficult to manage or change.

Furthermore, due to dimensional variations in existing permanent building walls, ceiling, and floors, space-dividing systems must be adaptable to accommodate these variables. Meeting the varied requirements of office workers within a given facility may require a combination of full and partial height dividers to provide a range of privacy levels corresponding to an individual user's job functions. However, presently available full height architectural walls are not readily reconfigurable, cannot be readily interconnected with partial height dividers, and also do not provide integrated utility distribution between the various types of dividers in the office space.

There is presently an oversupply of office space and furniture systems which do not properly respond to, or support change. Many older buildings do not have adequate utility capabilities, and the cost of conventional renovations or improvements often renders the same impractical. Even relatively new buildings can be quickly rendered obsolete by the fast paced changes in modern technology. The refurbishing of existing building space is therefore a concern which must be addressed by furniture systems.

One type of movable wall which may be used as a part of a solution to those issues noted above is a solid core partition, which has substantial sound transmission resistance. The use of a solid gypsum core provides significant structural and acoustic benefits, at a relatively low cost. However, conventional solid core partitions are typically custom built floor-to-ceiling installations, which do not adequately address the aforementioned concerns of routing utilities through the partition system. The lack of a prefabricated, modular design normally increases costs and installation time. Also, the use of a solid gypsum core, while being acoustically beneficial, inherently provides problems in high tech offices which require substantial power and cable support.

SUMMARY OF THE INVENTION

One aspect of the present invention is to provide a movable panel and associated frame for reconfigurable office partitions and the like, with an improved rigid stile disposed in a normally vertical orientation. The stile includes first and second channels extending longitudinally therealong which are shaped to receive utilities therein through outwardly opening sides. The outwardly opening sides of the first and second channels are juxtaposed in opposite directions to facilitate routing utilities therein along opposite faces of the frame.

Another aspect of the present invention is a movable panel for reconfigurable office partitions and the like. The panel includes a base shaped to be supported along a floor surface, and a top shaped to be supported along a ceiling surface. A prefabricated rigid frame is supported between the base and the top, and includes at least two stiles disposed in a normally vertical orientation, and extending on opposite sides thereof. At least two cross-members extend between and connect to the stiles in a vertically spaced-apart relationship to define with the stiles a pocket therebetween. A core panel, having a solid interior construction that provides a sound barrier, is mounted in the pocket. The stiles each include at least one channel, which extends longitudinally therealong and is shaped to receive utilities therein through outwardly opening sides. At least one cover panel is detachably mounted on the frame, and encloses at least a portion of opposite faces of the panel.

Yet another aspect of the present invention is in a movable partition panel of the type having a bottom, a top, opposite first and second faces, and opposite sides adapted for detachable connection with like panels. A first channel extending continuously from the bottom to the top of the panel in a normally vertical orientation defined by a closed rear side and shaped to receive utilities therein with an open outwardly oriented side through which utilities are inserted into the first channel. A second channel extends continuously from the bottom to the top of the panel in a normally vertical orientation defined by a closed rear side and shaped to receive utilities therein with an open outwardly oriented side through which utilities are inserted into the second channel. The first and second channel s are oriented in opposite directions, such that the first channel opens toward the first face and the second channel opens toward the second face, thereby permitting utilities to be routed vertically along both faces of the panel.

Yet another aspect of the present invention is a stile for reconfigurable partition frames. The stile includes a rigid upright having first and second channels extending longitudinally therealong and being shaped to receive utilities therein through outwardly opening sides. The outwardly opening sides of the first and second channels are juxtaposed in opposite directions to facilitate routing utilities therein along opposite faces of the partition frame.

Yet another aspect of the present invention is a reconfigurable office partition system including a floor track shaped to be supported along a floor surface, and a ceiling track shaped to be supported along the ceiling surface. A plurality of prefabricated rigid frames are supported between the base and the top. Each frame includes at least two stiles disposed in a normally vertical orientation, and extending along opposite sides thereof. The stiles each include at least one channel extending longitudinally therealong and being shaped to receive utilities therein through outwardly opening sides. The frames each include at least two cross-members extending between and connected to the stiles in a vertically spaced-apart relationship to define with the stiles a pocket therebetween. A core panel is mounted in the pocket, and has a solid interior construction that provides a sound barrier. A plurality of connectors detachably interconnect the frames in a side-by-side relationship, and a plurality of cover panels are detachably mounted on the frames, and enclose opposite faces of the panels.

Yet another aspect of the present invention is a movable panel for reconfiguring floor-to-ceiling office partitions and the like. The panel includes a floor track shaped to be supported on a floor surface. A ceiling track is shaped to be supported on a ceiling surface, and defines between the ceiling track and the floor track a floor-to-ceiling height. A prefabricated rigid panel frame is supported in a normally vertical orientation between the floor track and the ceiling track, and has a predetermined height less than the floor-to-ceiling height. The panel frame has a base portion operably connected with the floor track, and a top portion spaced vertically apart from the ceiling track. A variable height support extends between and interconnects the panel frame and the ceiling track. The panel support is vertically extensible, and includes a lock which rigidly retains the panel support at a selected height. At least one cover panel is detachably connected with at least one of the panel frame and the panel support, and encloses an associated portion of the same.

The principal objects of the present invention are to provide a solid core panel for reconfigurable office partitions and the like, which has substantial structural and acoustic properties, yet is capable of readily routing utilities, such as power and cable lines, along opposite faces of the panel. Preferably, the panel has a prefabricated, modular construction to reduce manufacturing costs and installation time, and is adaptable for use in floor-to-ceiling applications. The panel has vertically adjustable top and base members to accommodate a wide variety of applications. The panel is very durable, can be easily and quickly installed, efficient in use, and particularly adapted for the proposed uses.

These and other features, advantages and objects of the present invention will be further understood and appreciated by those skilled in the art by reference to the following specification, claims and appended drawings.

BRIEF DESCRIPTION OF THE DRAWINGS

FIG. 12 is a cross-sectional view of the upper bracket and structural extension taken along the line XII—XII, FIG. 10;

FIG. 13 is a cross-sectional view of the stanchion and structural extension taken line XIII—XIII, FIG. 10;

FIG. 14 is a fragmentary, cross-sectional view of the end portion of the panel frame taken along the line XIV—XIV, FIG. 10;

FIG. 21 is a fragmentary, cross-sectional view of the panel frame taken along the line XXI—XXI, FIG. 22;

FIG. 22 is a fragmentary, front elevational view of a portion of the panel frame showing the installation of a power receptacle;

FIG. 23 is a fragmentary, cross-sectional view of the panel frame taken along the line XXIII—XXIII, FIG. 24;

FIG. 24 is a fragmentary, front elevational view of a portion of the panel frame showing the installation of a power receptacle;

FIG. 35 is a fragmentary, front elevational view of the transom portion of the panel;

FIG. 36 is a fragmentary, exploded perspective view of the transom portion of the panel;

FIG. 38 is a top plan view of a lower cover panel;

FIG. 39 is a front elevational view of a lower cover panel;

FIG. 40 is a side elevational view of a lower cover panel;

FIG. 41 is a fragmentary, side elevational view of the panel of FIG. 4 showing the mounting clips of a lower cover panel;

DETAILED DESCRIPTION OF PREFERRED EMBODIMENT

For purposes of description herein, the terms "upper," "lower," "right," "left," "rear," "front," "vertical,"

Figure 1:
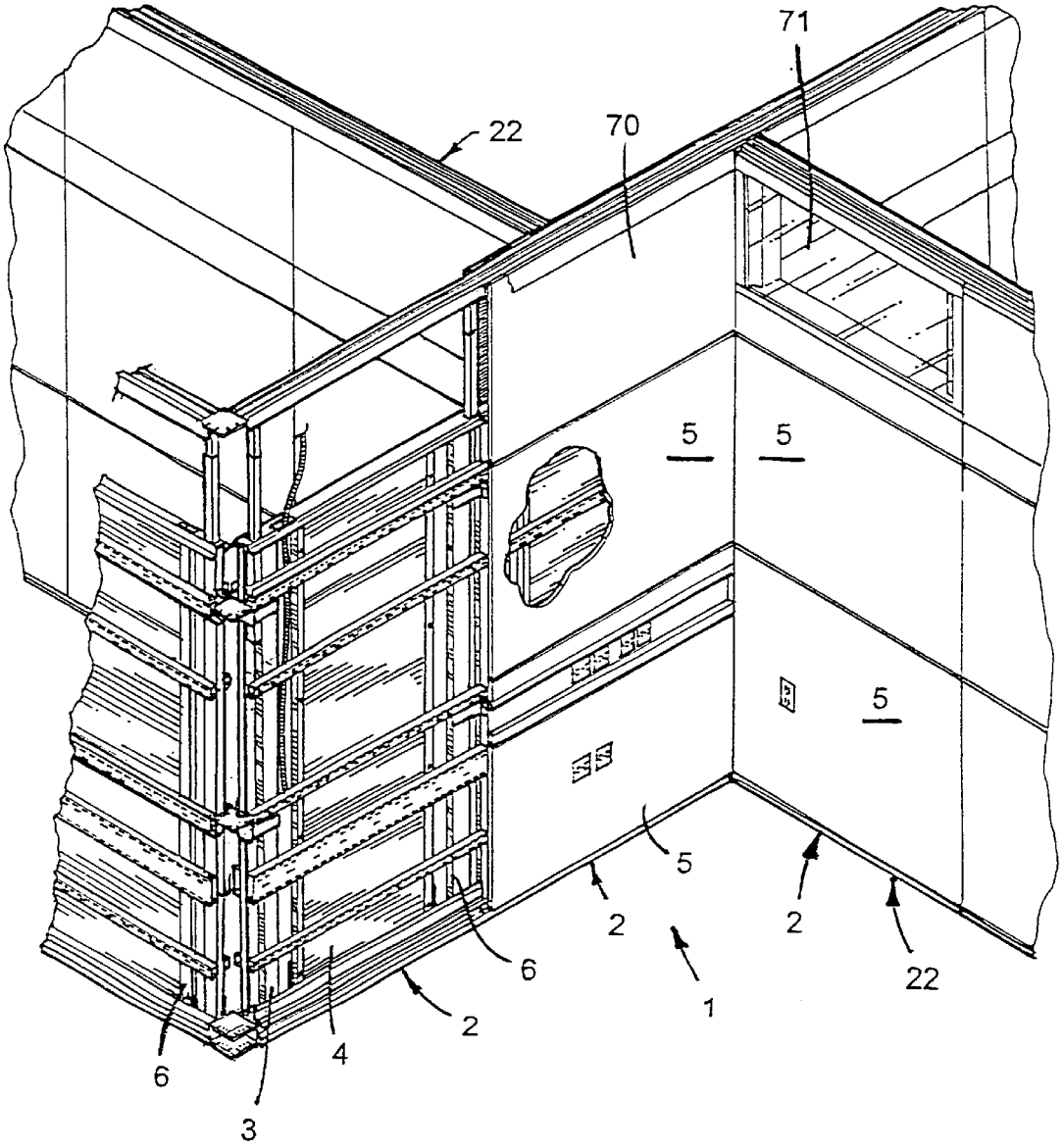
FIG. 1 is a fragmentary, perspective view of a reconfigurable office partition embodying the present invention, wherein a portion thereof has been broken away to reveal internal construction.

"horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a reconfigurable office partition system embodying the present invention, which is particularly designed for use in office spaces, and other similar settings and environments. In the illustrated example, the reconfigurable office partition system 1 includes at least one movable panel 2 with a rigid frame 3, a core panel 4 mounted therein, and at least one cover panel 5 detachably mounted on the frame 3 and enclosing an associated portion thereof. The frame 3 has at least one vertical side member or stile 6 (FIG. 2) with a first channel 7, and a second channel 8, each of which extend longitudinally along the vertical stile 6, and are shaped to receive utilities such as electrical power lines 9 or communications lines therein through outwardly-opening sides 10, 11. The outwardly-opening sides 10, 11 of the channels 7, 8 are juxtaposed in opposite directions to facilitate routing utilities along both faces 26, 27 of the panel 2. A variable height support 12 may be positioned between the top of the panel 2 and the building ceiling 13 for floor-to-ceiling applications.

Figure 2:
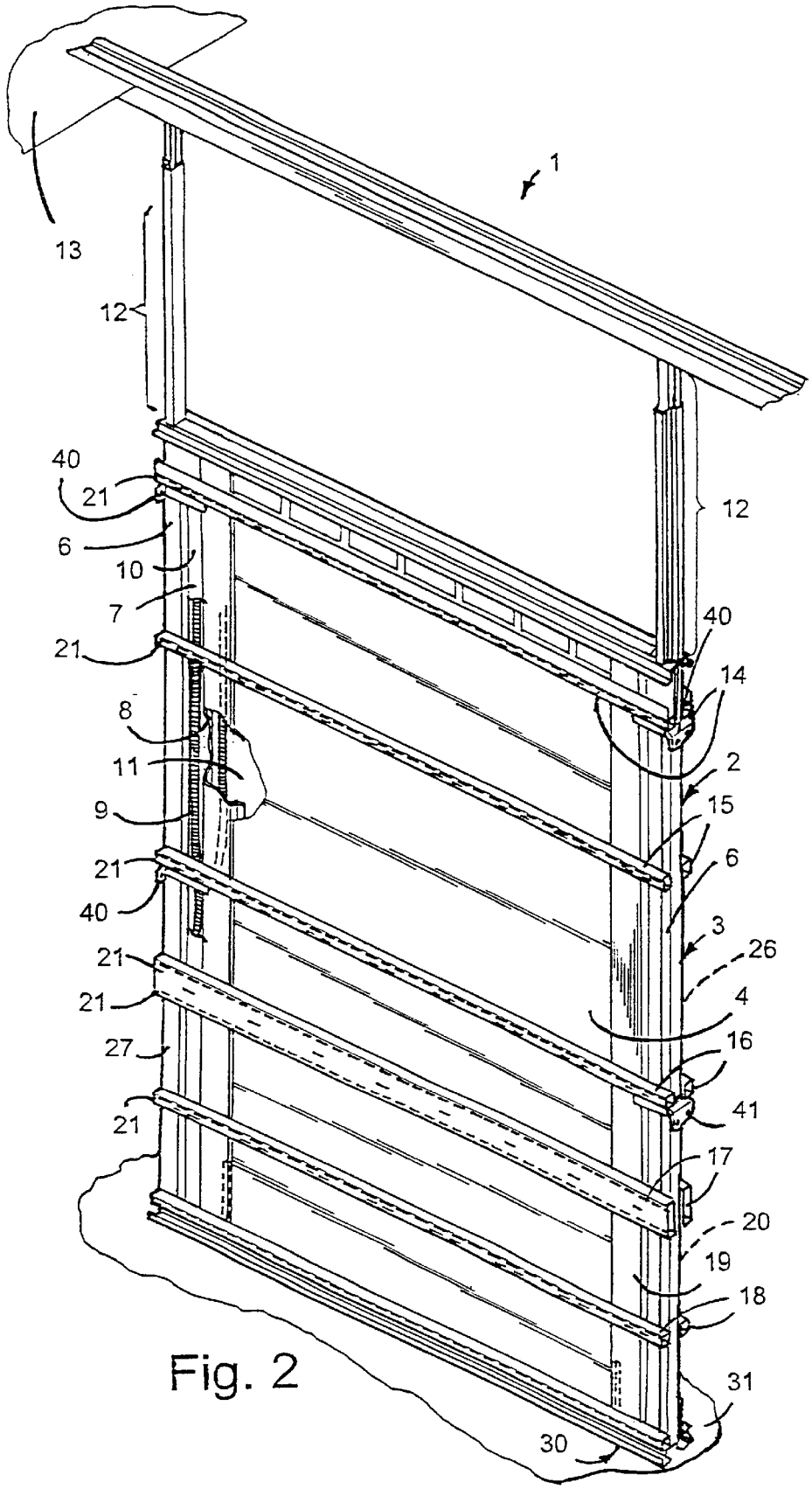
FIG. 2 is a perspective view of the panel frame showing the vertical stiles, cross members and variable height support.

As best seen in FIG. 2, the prefabricated rigid frame 3 of the present invention includes a pair of horizontally spaced-apart, vertically disposed stiles 6. Corresponding pairs of horizontal cross-members 14, 15, 16, 17 and 18 are welded to opposite side faces 19 and 20 of the vertical stiles 6. Each of the horizontal cross-members includes at least one horizontal row of slots 21 for removably supporting hang-on accessory units such as worksurfaces, storage bins, and the like (not shown). As described in more detail below, slots 21 also provide for connection of off-module panels 22 (FIG. 1). Stiles 6 and the other horizontal frame members may be fabricated from sheet metal by a roll-forming process.

Figures 3, 4, 5:
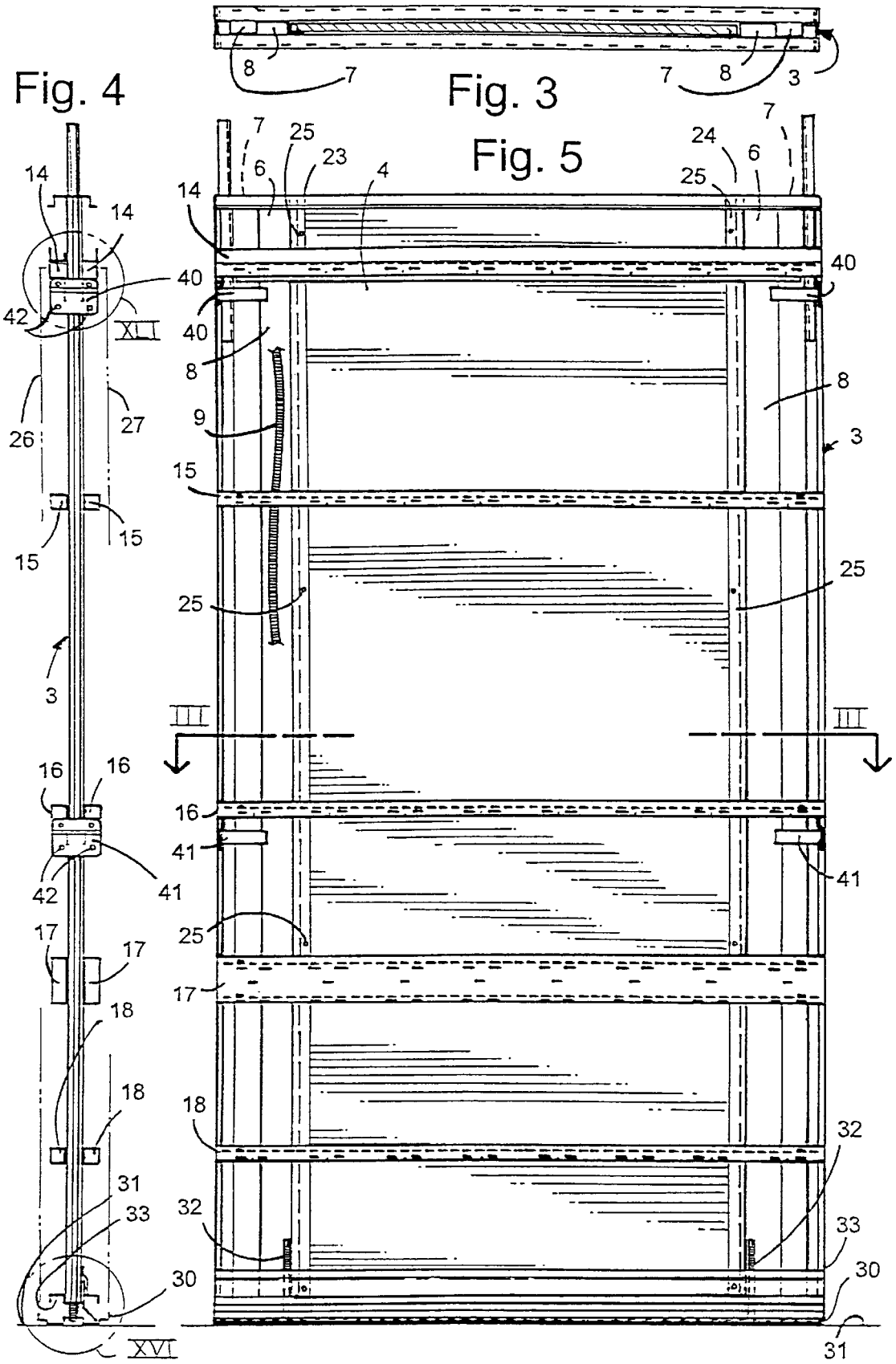
FIG. 3 is a cross-sectional view of the panel frame taken along the line III—III, FIG. 5.
FIG. 4 is a side elevational view of the panel frame.
FIG. 5 is a front elevational view of a first side of the panel frame.

With further reference to FIGS. 3–5, core panel 4 is preferably a gypsum sheet which is connected to stiles 6 along opposite side edges 23 and 24 by a plurality of fasteners, such as self-drilling screws 25. Although core panel 4 is preferably a gypsum sheet, the core panel could be constructed from other materials, including sheet metal, fiberglass or other materials that provide an acoustic barrier and/or sound-absorbing properties. Furthermore, core panel 4 could have a composite construction, wherein a sheet metal skin is combined with a fiberglass mat or other sound-absorbing material. The core panel 4 provides acoustical insulation, and, in combination with the floor-to-ceiling construction of the movable panel 2, forms a continuous acoustic barrier that provides greater privacy than partial-height office panel systems. However, because the cover panels 5 do not obstruct the horizontal rows of slots 21, the reconfigurable office partition 1 of the present invention provides for hang-on accessory units (not shown), and also provides for attachment of off-module wall panels 22 in a manner that is not possible with conventional architectural walls.

Figures 6, 7, 8:
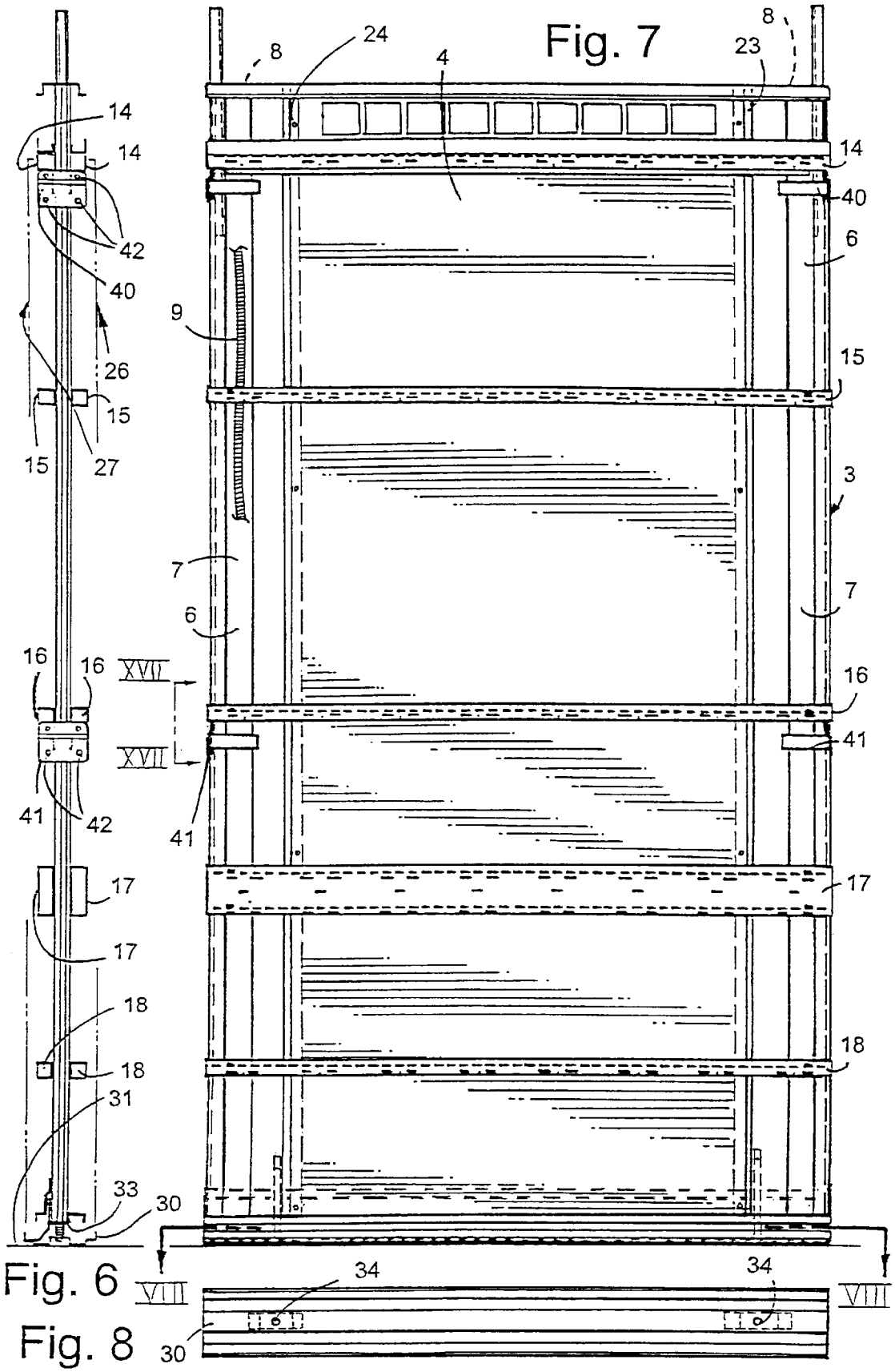
FIG. 6 is a side elevational view of the panel frame.
FIG. 7 is a front elevational view of a second side of the panel frame.
FIG. 8 is a cross-sectional view of the panel frame taken along the line VIII—VIII, FIG. 7.

The channels 7 and 8 formed by the vertical stiles 6 permit utilities such as power and communications lines and the like to be routed vertically from the floor to the ceiling. The second vertical channels 8 permit routing utilities along the first side face 26 (FIG. 4) of the panel 2, and the first channels 7 permit routing utilities along the second side face 27 (FIG. 6) of the movable panel. As described in more detail below, power and communications receptacles can be mounted at various locations on the panel, thereby providing utilities throughout the office space as required for a given application. Although the frame 3, including vertical stiles 6, can form a floor-to-ceiling partition, frame 3 may also form part of a partial height panel system if required for a particular application.

A floor track 30 (FIG. 5) is disposed directly below the panel frame 3, and is shaped to support the panel 2 on the floor surface 31. In the illustrated example, a pair of jack screws 32 extend downwardly from lower horizontal frame member 33 and engage openings 34 (FIG. 8) in the floor track 30. Jack screws 32 permit the panel frame 3 to be vertically adjusted to account for variations in the existing floor surface 31. As described in more detail below, upper and lower panel-to-panel connector brackets 40 and 41 (FIGS. 4, 6) each include a plurality of clearance holes 42 that receive fasteners for interconnecting adjacent panels 2.

Figure 9:
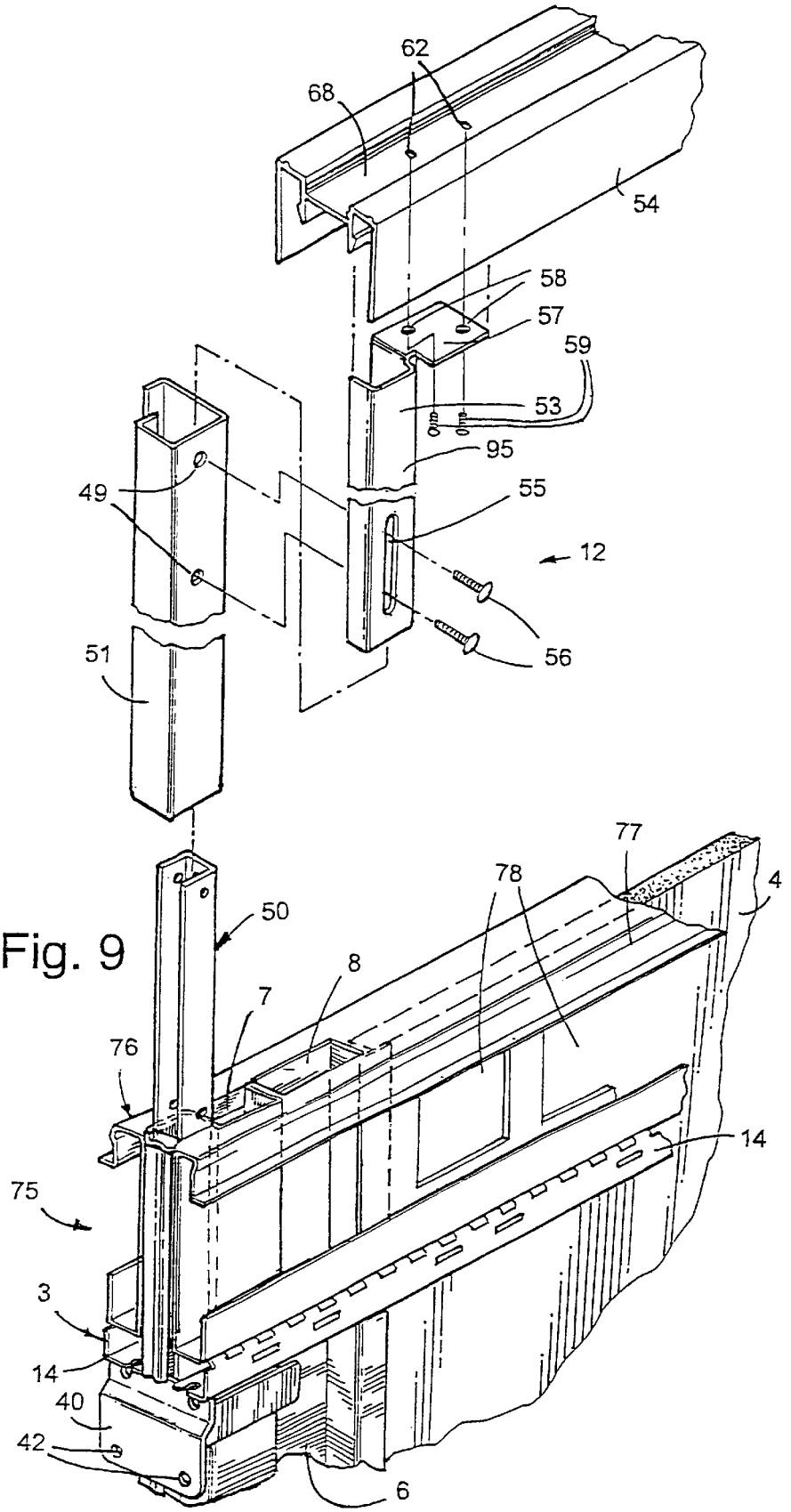
FIG. 9 is a fragmentary, perspective view of the upper portion of the panel frame showing the expressway and a variable height support.

With reference to FIG. 9, the illustrated variable height support 12 includes a stanchion 50 having a generally C-shaped cross section. The stanchion 50 is rigidly connected to panel frame 3 and, when assembled, extends upwardly into a structural extension 51 having a generally G-shaped cross section. A pair of fasteners such as self-drilling and/or self-tapping screws 52 (FIG. 11) rigidly connect the structural extension 51 to the stanchion 50. Fasteners 56 pass through vertically elongated slot 55 in lower portion 95 of upper bracket 53 into holes 49 in extension 51, thereby interconnecting the structural extension 51 and the upper bracket 53 in a telescoping manner to provide adjustment to account for variations in the floor-to-ceiling height (FIG. 4). If required, structural extension 51 can be cut to length during installation to provide additional vertical adjustment. Accordingly, variable height support 12 can be prefabricated, and adjusted to fit a wide range of floor-to-ceiling heights during installation. Fasteners 59, such as self-drilling and/or tapping screws, are installed through clearance holes 58 in flange 57 of the upper bracket 53 into holes 62 in web 68 of ceiling track 54, thereby securing the panel frame 3 with the ceiling track 54. Stanchion 50, structural extension 51 and upper bracket 53 are preferably formed from sheet metal such as steel, and ceiling track 54 is extruded aluminum.

Figures 10, 11:
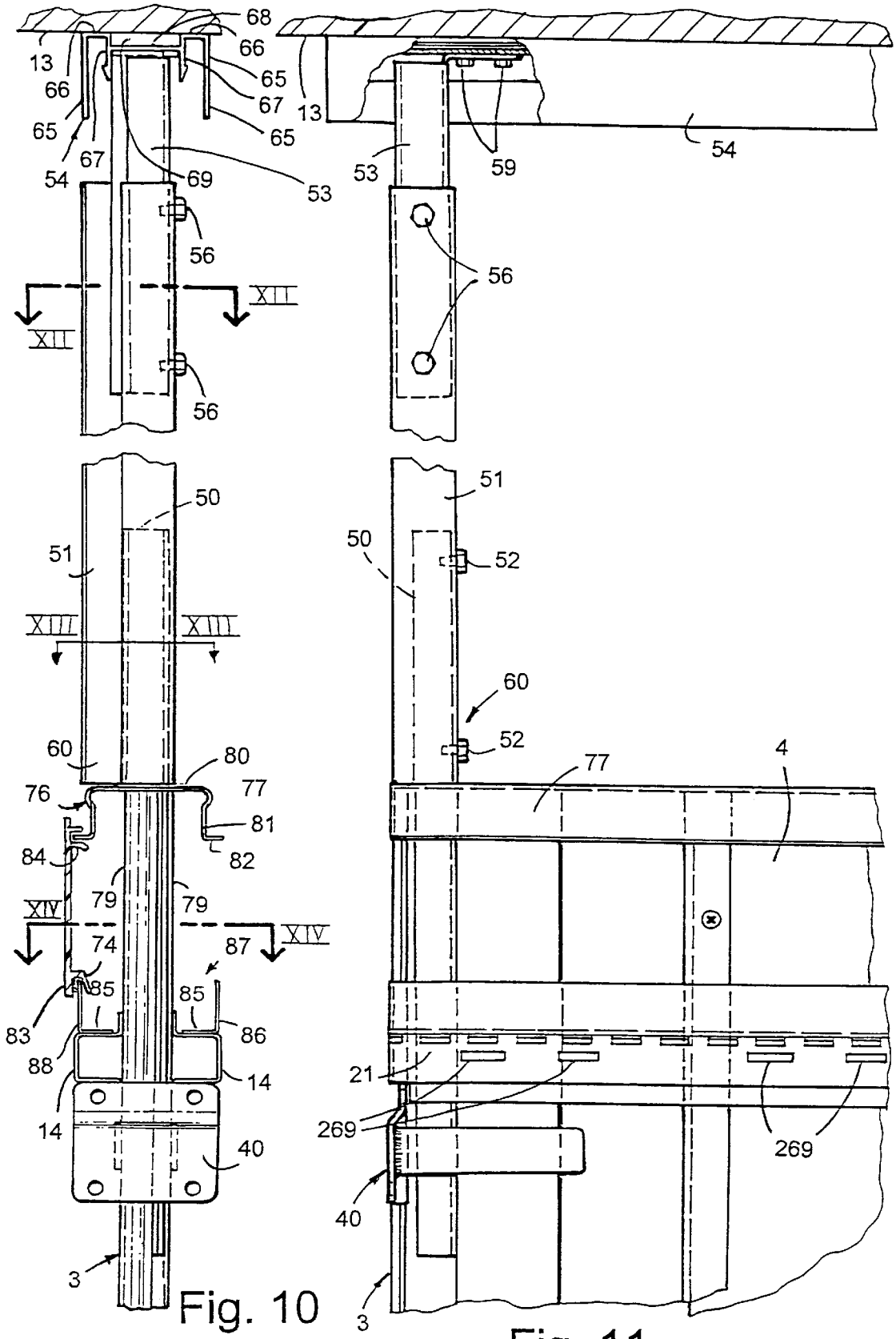
FIG. 10 is a fragmentary, side elevational view of the upper portion of the panel frame, including the variable height support.
FIG. 11 is a fragmentary, front elevational view of an upper portion of the panel frame.

An expressway 75 comprises a pair of outwardly-opening channel members 76 and 77 which are welded or bolted to the stile 6, and provide horizontal utility routing capability on each side of the panel. The channels 76 and 77 may include cut-out portions 78, such that the core panel 4 may be cut to provide cross-routing of utilities between the two sides of the panel. As best seen in FIG. 10, each channel includes a vertical web 79 with an upper horizontal web 80 and a downwardly-extending web 81 forming a downwardly-opening U-shape. Channels 76 and 77 further include a lower horizontal web 85 and a upwardly-extending flange 86 that define an expressway channel 87 to supportably retain lay-in utilities, such as power and communications lines. Clips 74 and 84 of expressway cover 83 engage flanges 86 and 82 to removably attach expressway cover 83 to a channel 76 and/or 77. Alternatively, as described in more detail below, the channels 76 and 77 may be covered by a cover panel that extends from the ceiling track 54 to flanges 86, 88 of channels 76, 77.

Ceiling track 54 includes a pair of downwardly-extending side walls 65, a pair of horizontal upper webs 66, and a pair of downwardly-extending inner flanges 67. Center web 68 extends between the inner flanges 67, and is offset from the ceiling surface 13 to define a passage 69. When assembled, flange 57 of upper bracket 53 abuts the lower surface of the center web 68, and passage 69 provides clearance for the ends of fasteners 59. As described in more detail below, ceiling track 54 also supports a cover panel 5 or a glass module 71 (FIG. 1).

Figure 43:
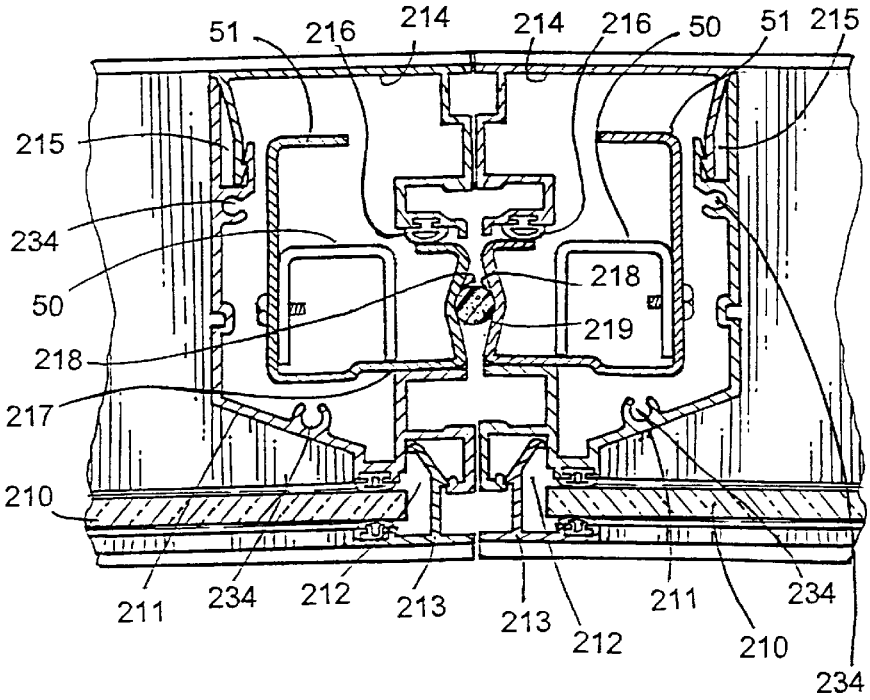
FIG. 43 is a fragmentary, cross-sectional view of a glass module taken along the line XLIII—XLIII FIG. 42.

With reference to FIG. 12, structural extension 51 includes side walls 90, 91 and 92, with flanges 93 and 94 extending from the side walls 92, 90, respectively. Although sidewall 90 could be flat, in the illustrated embodiment sidewall 90 is indented at 218 to retain a compressible cylindrical seal 219 along an adjacent extension 51 (see also FIG. 43). As discussed below, extension 51 may include an indented portion 217 (FIG. 43). The lower portion 95 of bracket 53 has a generally C-shaped cross section with a base wall 96, and a pair of side walls 97 and 98 extending orthogonally therefrom (FIG. 12). As discussed above, self-tapping fasteners 56 are received in clearance holes 49 (FIG. 9) of structural extension 51 through slot 55 in bracket 53 to provide telescoping adjustment to account for variations in the floor-to-ceiling height.

With reference to FIG. 13, the lower portion 60 of structural extension 51 is securely fastened to the stanchions 50 by self-drilling and/or tapping fasteners 52. Stanchion 50 has a base wall 100, with a pair of side walls 101, 102 extending transversely therefrom. The structural extension 51 forms a vertical passage 99 through which utilities may be routed. In addition, the structural extension 51 may be used along either side edge of the panel frame by inverting the structural extension 51, such that the side walls 90, 91 and 92, as well as the flanges 93 and 94 are oriented in the opposite direction, thereby providing a "mirror image" of the orientation illustrated in FIGS. 12 and 13.

With reference to FIG. 14, the stile 6 has a generally S-shaped cross section forming first and second channels 7 and 8 for vertical routing of utility lines and the like. Stiles 6 extend vertically along opposite sides of frame 3. Each stile 6 includes an inwardly-projecting mounting flange 105 defining a pocket 104 between the stiles 6 that is adapted to receive a core panel 4 therein. Self-drilling and/or tapping screws 25 or other fasteners secure the core panel 4 to inwardly-projecting mounting flange 105 of the stile 6. The first channel 7 is shaped to receive utilities, and includes a wall 110, from which transverse walls 107 and 108 extend to define an outwardly-opening side 115. Second channel 8 is also shaped to receive utilities, and includes a wall 109, from which transverse walls 106 and 107 extend to define an outwardly-opening side 116. First and second channels 7, 8 are positioned in a side-by-side relationship, with wall 107 being common to and separating the first and second channels 7, 8. Because the thickness of the core panel 4 is less than the length of the transverse wall 106, the core panel 4 is disposed at an off-center position. A side web 111 extends outwardly from the transverse wall 108, with a side flange 112 extending generally transversely therefrom. The side flange 112 includes an elongated indented channel 113 which retains an elastomeric, cylindrical seal strip 114 between adjacent side flanges 112 when a pair of adjacent frames 3 are interconnected in an end-to-end manner.

Figure 15:
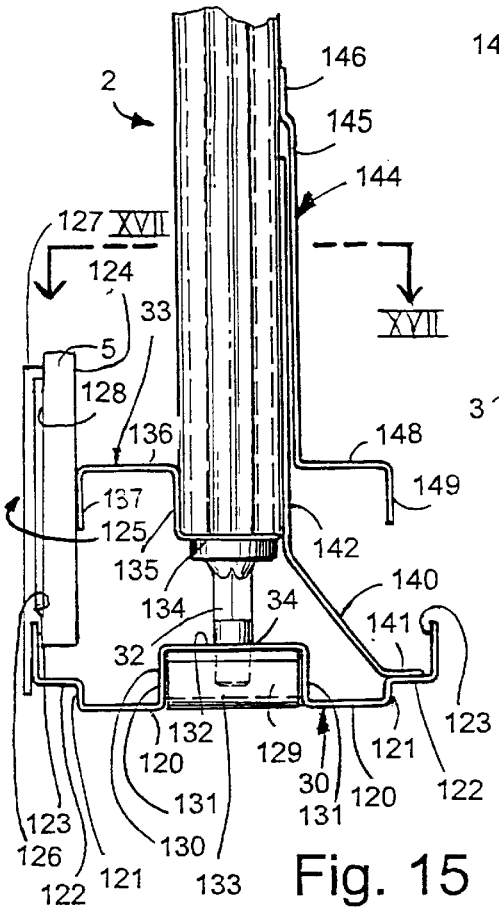
FIG. 15 is a fragmentary, side elevational view of the lower portion of the panel frame of FIG. 4.
Figure 16:
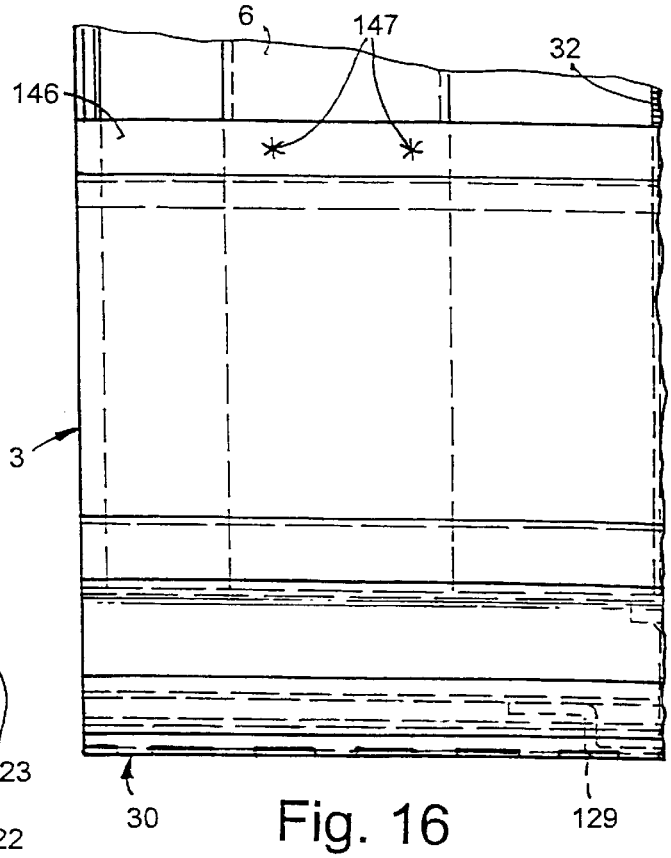
FIG. 16 is a fragmentary, front elevational view of the lower portion of the panel frame of FIG. 15.

With reference to FIGS. 15 and 16, floor track 30 has a pair of lower webs 120 that abuttingly support the panel 2 on a floor surface. Floor track 30 further includes a pair of upwardly-extending step portions 121 and horizontal flange portions 122. Upwardly-extending side flanges 123 receive clip 126 of base trim 125. Upper edge 127 of base trip 125 abuts outer surface 128 of lower cover panel 5, thereby permitting the panel to be vertically adjusted using jack screw 32. A U-shaped brace 129 is welded into the channel 133, and receives the end 130 of jack screw 32.

Lower horizontal frame member 33 comprises a lower web 134 which abuts the lower end of stiles 6, a vertical web 135, horizontal web 136, and downwardly-extending outer flange 137. The outer flange 137 abuttingly supports the inner surface 124 of the lower cover panel 5.

Figure 17:
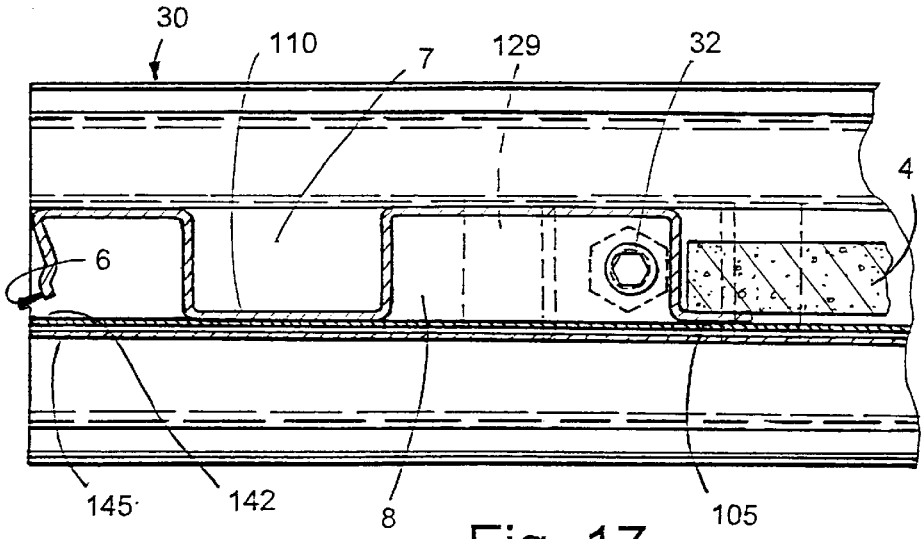
FIG. 17 is a fragmentary, cross-sectional view of the panel frame taken along the line XVII—XVII, FIG. 15.

An upwardly-extending acoustic barrier 140 is welded to the horizontal web 122 at a lower end 141, and includes an upwardly-extending flange portion 142 which is received behind the offset portion 145 of flange member 144. The upper portion 146 of flange member 144 is spot welded to stile 6 at 147 (FIG. 16). Flange member 144 includes a horizontal web 148 and a downwardly-extending outer flange 149 which supports a cover panel 5 in substantially the same manner as flange 137. Because the upwardly extending portion 142 of the acoustic barrier 140 is closely received behind offset portion 145 of flange member 144, an acoustic seal or barrier is maintained along the lower edge of the panel 2. Furthermore, the upwardly-extending portion 142 is not fixed to the panel frame 3, thereby allowing the panel to be raised and lowered relative to the floor track 30 by means of jack screws 32, while maintaining the acoustic seal. With further reference to FIG. 17, upwardly-extending flange portion 142 of acoustic barrier 140 abuts web 110 and flange 105 of stile 6.

Figure 18:
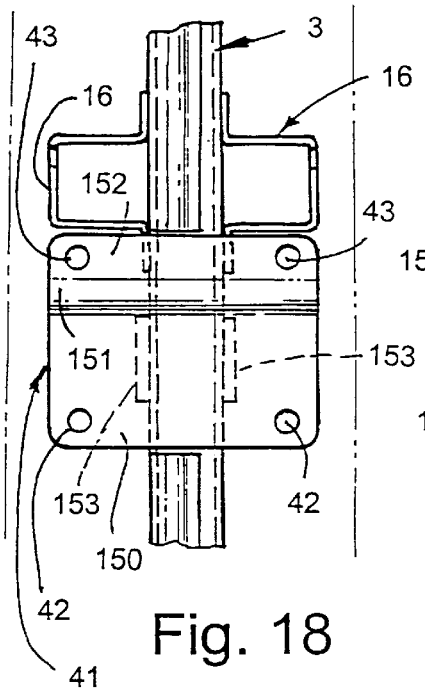
FIG. 18 is a fragmentary view of the lower panel-to-panel connector bracket taken along the line XVIII—XVIII, FIG. 7.
Figure 19:
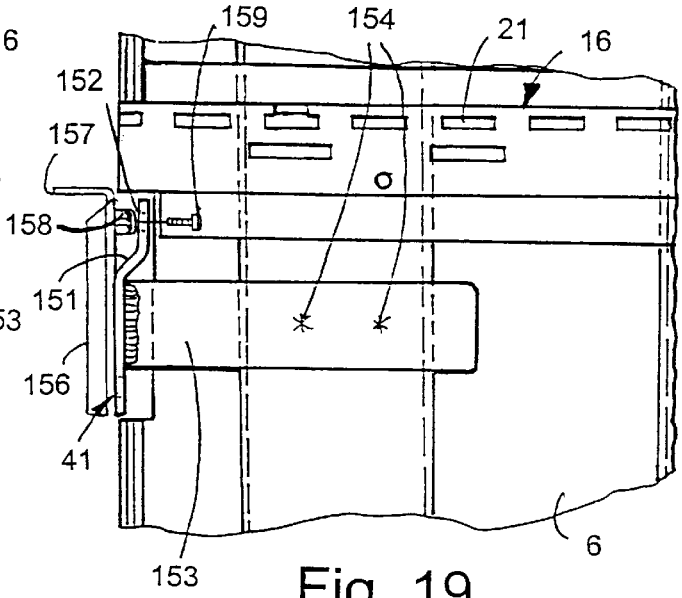
FIG. 19 is a front elevational view of the lower connector bracket of FIG. 18.
Figure 20:
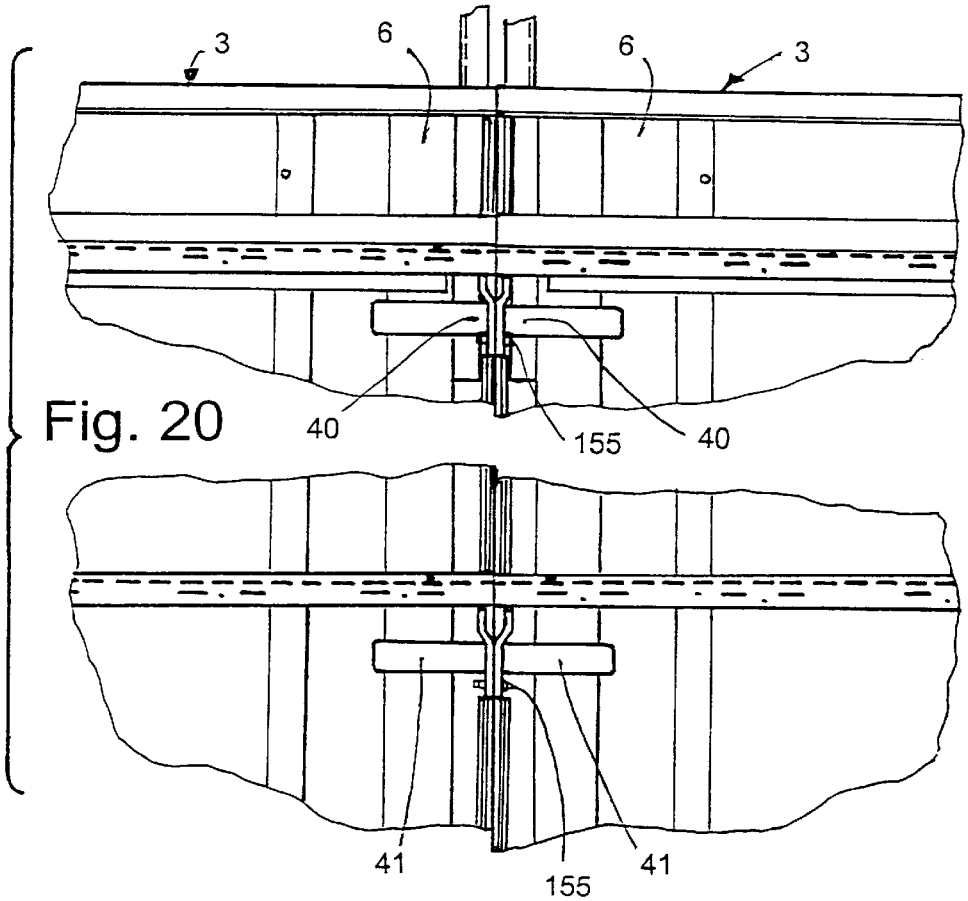
FIG. 20 is a fragmentary, front elevational view of adjacent panel frames showing the interconnection of the upper and lower panel-to-panel connector brackets of adjacent panel frames.

With reference to FIGS. 18 and 19, lower panel-to-panel connector bracket 41 includes a plate 150 having an angled portion 151 and an inwardly-offset portion 152. A pair of elongated side straps 153 are welded to the plate 150, and stile 6 at 154. Upper panel-to-panel connector brackets 40 are substantially the same as brackets 41, and hence will not be described further herein. As best seen in FIG. 20, when a pair of adjacent panel frames 3 are aligned in an end-to-end manner, the clearance holes 42 of adjacent upper brackets 40 are aligned and receive fasteners 155 to rigidly interconnect the adjacent panels 2. Similarly, clearance holes 42 of adjacent lower brackets 41 also receive fasteners 155. An off-module connector bracket 156 (FIG. 19) includes an upper portion 157 having horizontal hooks that are configured to engage slots 21 of an adjacent panel to interconnect a pair of panels in an off-module configuration. A pair of nuts 158 are welded to connector bracket 156, and a fastener 159 is inserted through clearance holes 42 and 43 to secure bracket 156 to a bracket 40 or 41. Because hooked portion 157 may be connected to selected ones of the slots 21, an off-module panel may be positioned at selected locations corresponding to the horizontal slot-to-slot spacing.

With reference to FIGS. 21 and 22, an electrical receptacle 160 may be mounted between horizontal frame members 15 and 16. A bracket 161 includes an upper L-shaped portion 162 which is attached to the lower surface of frame member 15 by fastener 163. Lower bracket portion 164 has a generally L-shaped cross section, and is fastened to upper portion 162 by fasteners 166. Slots 167 may be provided in upper or lower portions 162 or 164 to provide vertical length adjustment of bracket 161 if required. Angle bracket 165 and fastener 166 connect the lower portion of the bracket 161 to the horizontal member 16. If required, an opening 168 is cut in the core panel 4 to provide clearance for the rear portion 169 (FIG. 21) of the electrical receptacle box 160. A cover 170 is then secured over the opening using fasteners 171 to provide an acoustic barrier. Electrical conduit 173 can be routed from the receptacle 160 vertically along the channel 8.

With reference to FIGS. 23 and 24, an electrical receptacle 172 may be mounted at a selected location between horizontal cross-members. In the illustrated example, a horizontal adapter strip 175 is secured to the stiles 6 by fasteners 176. The receptacle 176 is supported by connector 177 at the desired horizontal location. If required, the core panel 4 can be cut-out at 178, and a cover 179 installed to provide an acoustic barrier. The electrical lines 180 may then be routed vertically through channel 7 or 8, depending on which side of frame 3 the receptacle is mounted on.

An upper cover panel 248 (FIG. 25) includes a large sheet metal panel 250 with top, bottom, and side edge flanges 251, 252, and 253, respectively, formed thereon for stiffening the panel 250. Additional stiffeners 250A can also be added, if required. It is noted that, alternatively, the transom coves 248 can be made from a large panel of composite material or other lightweight material with edge extrusions or roll-forms attached to its edges and back surface for strength. The bottom edge flange 252 includes a turned or hooked flange 254 forming a downwardly facing hook-shaped connector for matingly engaging the flange 186 on top plate 185 on expressway construction 75, or for matingly engaging the flange 86 of C-channel 76 and 77 of the expressway 75. Attached along a top of the top edge flange 251 is a connector 255. The connector 255 (FIG. 26) includes a flag-shaped attachment flange 256 with a reversely bent lip 257 that is adapted to receive the exposed edge of the top edge flange 251 of panel 250. A screw is extended through a hole 258 in the attachment flange 256 and threadably into the top flange 251 to secure the top connector 255 in place on the top edge flange 251. Alternatively, the top connector 255 can be welded, adhered, or otherwise secured. An elongated bendable/flexible arm section 259 extends from attachment flange 256, and a tab 260 with a slot 261 therein extends from the end of the elongated arm section 259. A screw 262 is extended through the slot 261 and threadably into a side wall 65 to attach the top connector 255 to the ceiling channel 54. The elongated arm section 259 is bendable, and permits the tab 260 to be aligned with a side wall 65 as desired, such as to align with a screw hole. As discussed below, trim piece 200 is attached to a side of the ceiling channel 54 to cover the space immediately below the building ceiling adjacent the ceiling channel 54.

Figure 27:
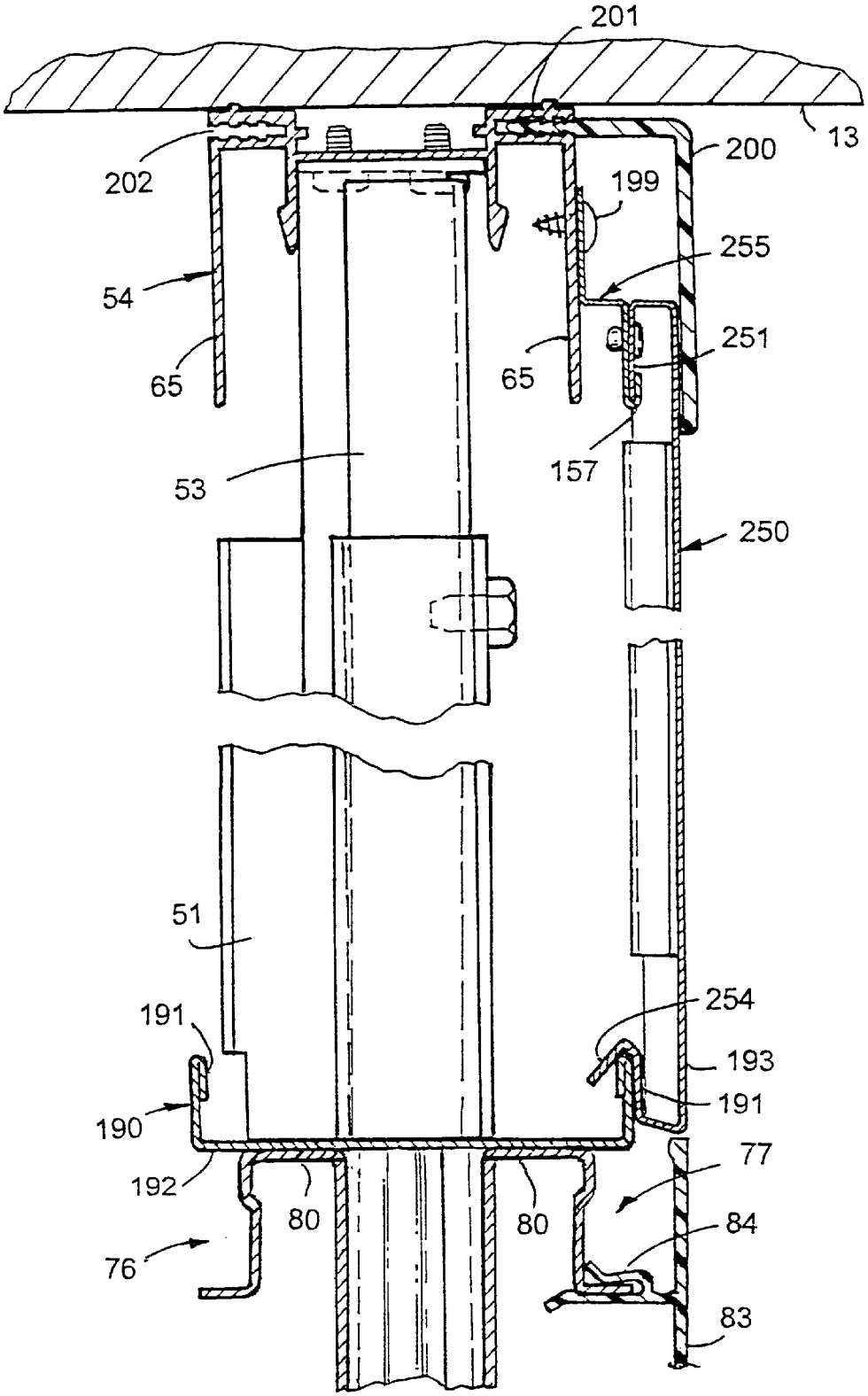
FIG. 27 is a fragmentary, cross-sectional view of the upper portion of the panel taken along the line XVII—XXVII, FIG. 35.

With reference to FIG. 27, a U-channel 190 may be welded, or otherwise fastened to the web 80 of channels 76 and 77. Channel 190 includes upwardly-extending folded over flanges 191 and a horizontal web 192. A plurality of holes (not shown) may be provided in the web 192 in the area between the stanchions 50 if required to provide access for wiring along channels 7 and 8 of stile 6. Panel 250 has a sheet metal skin 193 which forms a downwardly-opening hooked flange 254 along the lower edge of the panel 250. The hooked flange 254 supports the panel 250 on the flange 191 of the U-channel 190 for applications in which an expressway cover 83 is used. Alternatively, the panel 250 may have sufficient height to extend downwardly to cover the channels 76 and 77, with the hooked lower flange 254 supporting the panel 250 on the flanges 86 or 88 of C-shaped channel 77, 76 (see also FIG. 10). A top connector 255 is connected to the flange 251 of panel 250, and fasteners 199 are received in slots 261 to secure the upper edge of the panel 250 to the sidewall 65 of the ceiling track 54. In the embodiment illustrated in FIG. 30, the ceiling track 54 includes a pair of grooved channels that extend along the base of the sidewalls 65. The channels 202 removably receive the barbed end portion 201 of a polymeric cover trim 200.

Figure 30:
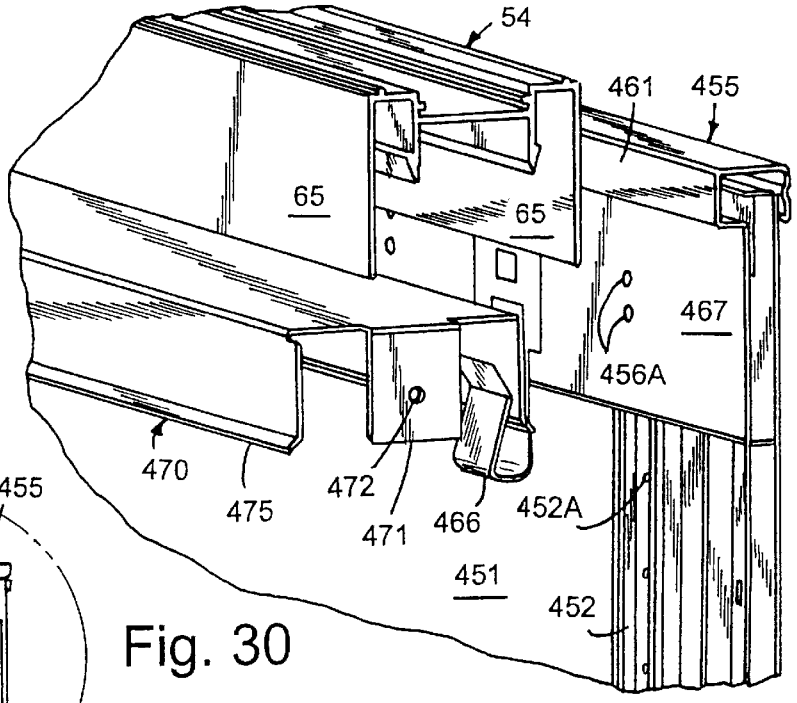
FIG. 30 is a fragmentary, perspective view of the ceiling track and cover panel of FIG. 28.
Figure 28:
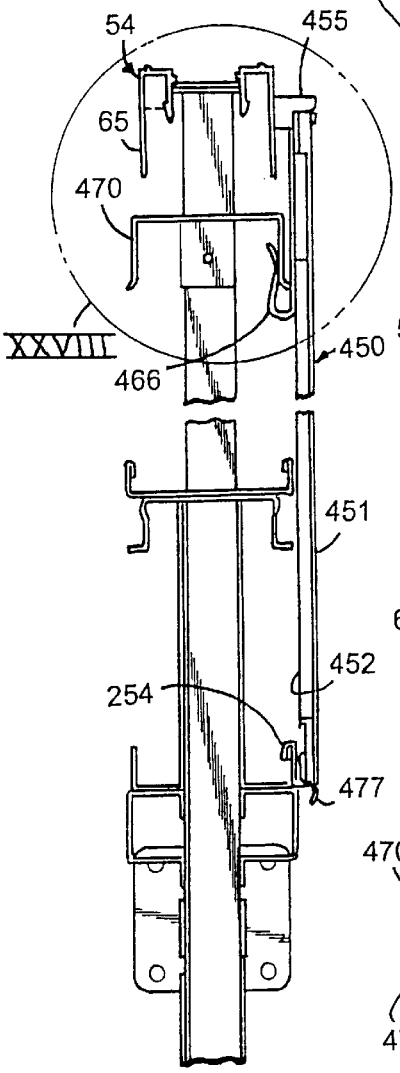
FIG. 28 is a fragmentary, side elevational view of the transom portion of the panel showing a second type of upper cover panel.
Figure 29:
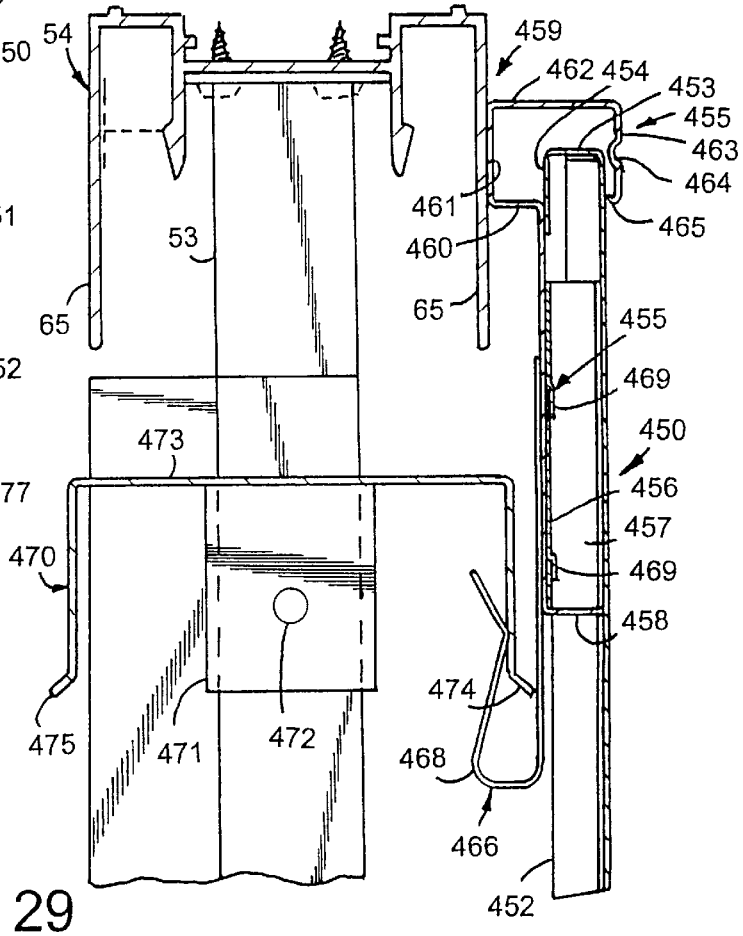
FIG. 29 is a fragmentary, side elevational view of the upper portion of the transom and cover panel of FIG. 28.

A modified upper cover 450 supported by a modified top connector arrangement is shown in FIGS. 28–30. Upper cover 450 includes a flat body 451 formed from sheet metal, composite material, or the like, and includes side edge stiffeners or side flanges 452. The top edge of the illustrated sheet metal body panel 451 is reversely bent to form a flat top section 453 and back flange 454. A top connector 455 for upper cover 450 includes a flat lower section 456 that extends parallel the body panel 451. Side and bottom flanges 457 or 458 are formed on or attached to lower section 456 to form a box-shaped platform that stably abuts a rear side of body panel 451. The lower section 456 is screwed into the edge stiffeners 452.

The upper section 459 of top connector 455 includes a rearwardly bent flange 460, a standoff flange 461 for abutting a side wall 65 of ceiling channel 54, and a forwardly bent flange 462. A down flange 463 extends from forwardly bent flange 462, and includes a radiused ridge 464 that provides a aesthetic line for appearance and that abuts a face of the body panel 451. A rearward curled lip 465 on down flange 463 hides any burrs or unevenness on curled lip 465 and further provides a grip for securely retaining any upholstery or vinyl covering on transom cover 450. The curled lip 465 also prevents such upholstery or fabric from unraveling, which unraveling can be a problem in field cut covers.

A J-shaped spring clip 466 includes an attachment leg 467 for attachment to lower section 456 and a resilient U-shaped lower leg 468. Attachment leg 467 includes tabs 469 configured and bent to securely engage the lower section 456 to secure the clip 466 to the top connector 455.

An adapter bracket 470 (FIG. 28) includes a lower end 471 shaped to matably engage the structural extension 51, and includes a tab hole 472 for screw attachment thereto. An inverted U-shaped section 473 extends from lower end 471 and includes arms with down flanges 474 and 475. Adapter bracket 470 is attached to structural extension 51 so that the down flange 474 (or 475) is engagable by the lower leg 468 of the J-shaped spring clip 466 when the transom cover 450 is installed. An adapter bracket 470 is attached to each structural extension 51.

To field cut the transom cover 450, the top connector 455 is removed by removing screws in holes 452A and 456A, and the upper edge of the cover 450 is then cut to a desired height. The top connector 455 is then reattached by extending the screws through holes 456A into a newly selected hole 452A in transom cover 450. The adapter brackets 470 are attached to the associated structural extensions 51 at a desired height. The transom cover 450 is then removably attached by extending spring clip 466 into mating engagement with down flange 474 of adapter brackets 470, and then by lowering the bottom hook connector 254 into engagement with up flange 86. Notably, the transom cover 450 can include a flexible light seal 477 at its bottom if desired for improved aesthetics.

Figures 25, 26:
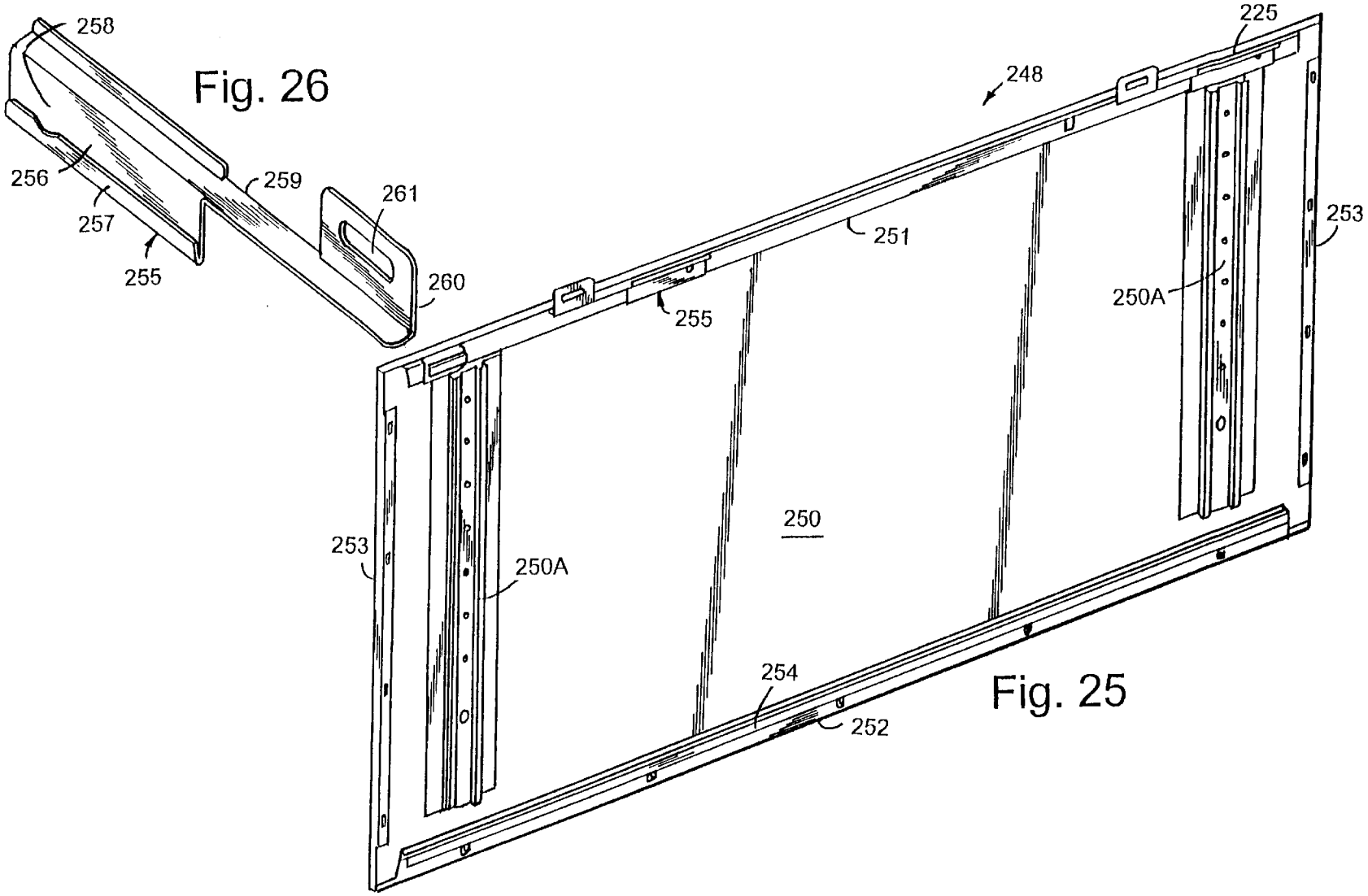
FIG. 25 is a perspective view of an upper cover panel.
FIG. 26 is a perspective view of a top connector that is used with the upper cover panel of FIG. 25.
Figure 31:
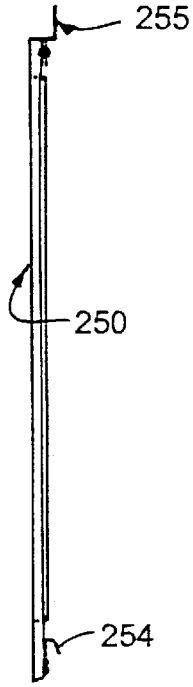
FIG. 31 is a side elevational view of the cover panel of FIG. 25.
Figure 32:
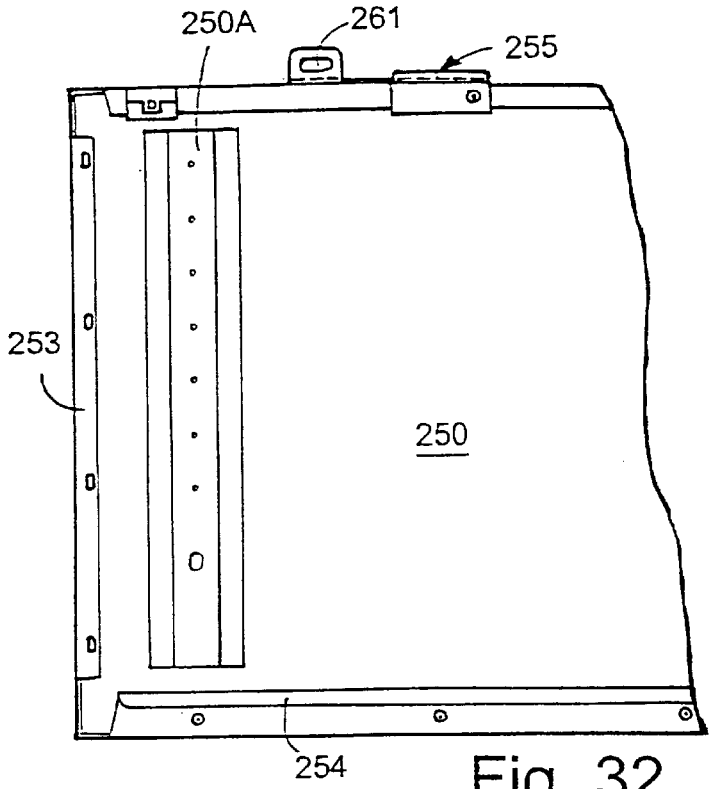
FIG. 32 is a fragmentary, front elevational view of the cover panel of FIG. 25.
Figure 33:
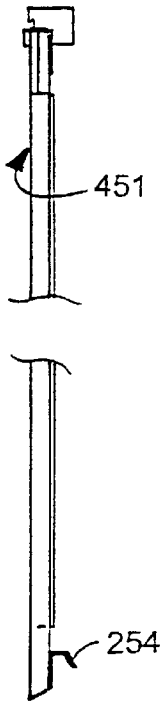
FIG. 33 is a fragmentary, side elevational view of the cover panel of FIG. 27.
Figure 34:
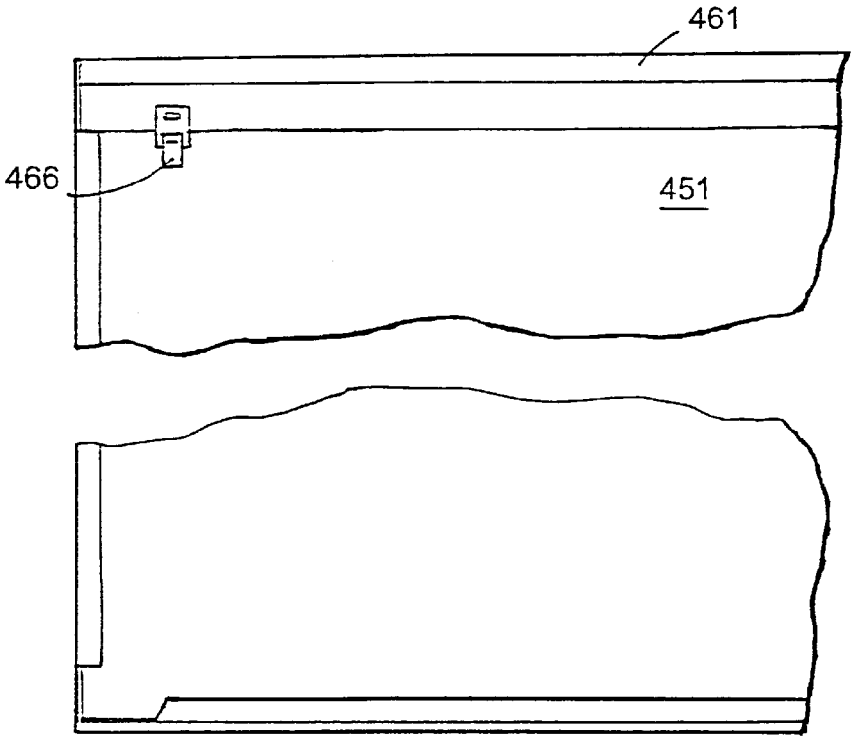
FIG. 34 is a front elevational view of the cover panel of FIG. 27.

FIGS. 31 and 32 further illustrate the panel 250 of FIG. 25, and the top connector 255 illustrated in FIG. 26. FIGS. 33 and 34 further illustrate the sheet metal body panel 451 of FIGS. 27, 28 and 29. FIGS. 35 and 36 further illustrate installation of panel 250. Flange 254 is placed onto upwardly-extending flange 86 of C-shaped channel 76 or 77, and the panel 250 is brought into contact with the ceiling rail 54. A self-tapping screw 199, or other fastener is then installed into hole 265 to secure the upper portion of the panel 250 to the ceiling track 54. The barbed end portion 201 of trim piece 200 is then inserted into the channel 202 of the ceiling track 54, thereby completing the installation of the panel 250.

Figure 37:
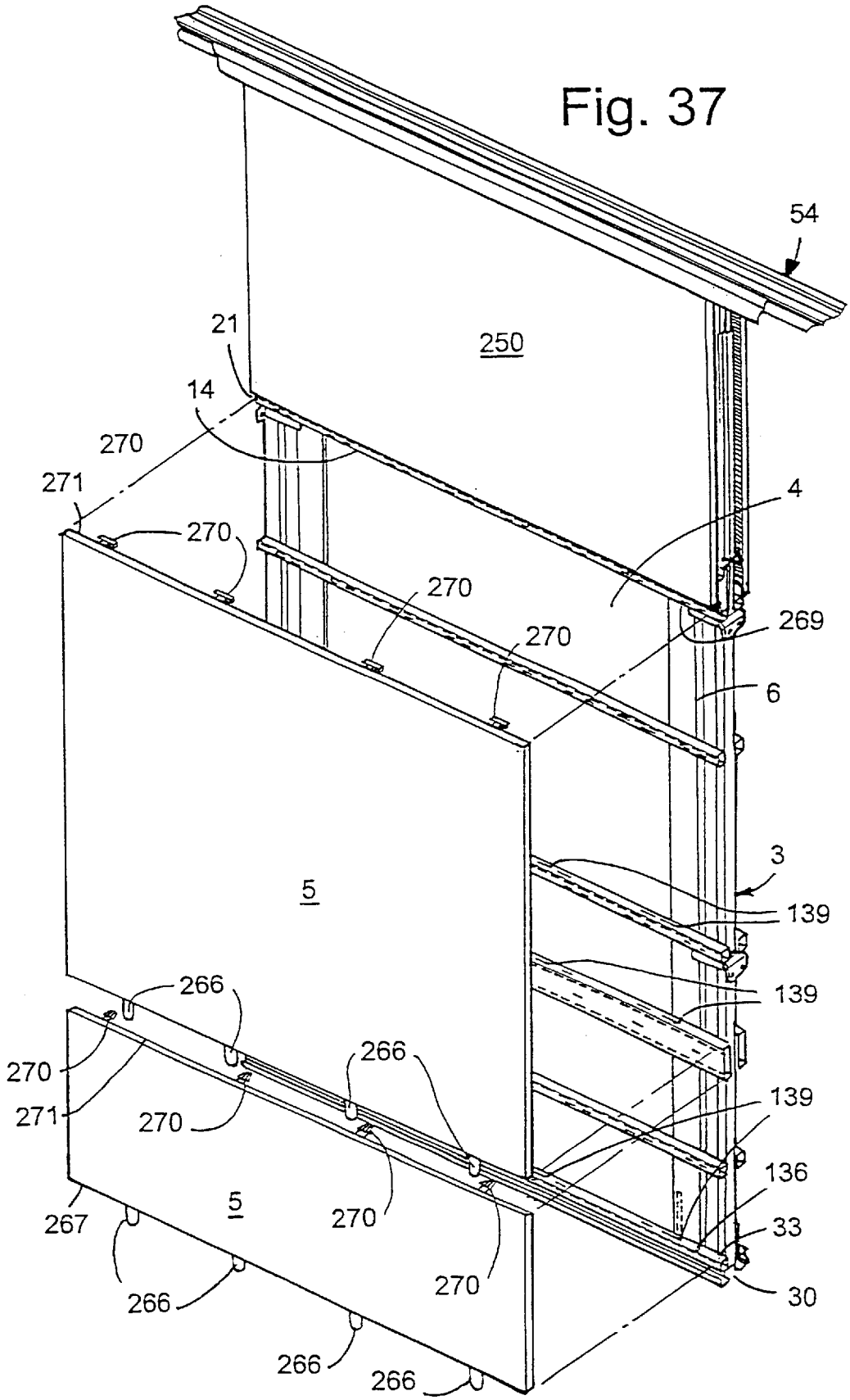
FIG. 37 is a partially exploded, perspective view of the panel showing the mounting of the lower cover panels.

With reference to FIG. 37, the horizontal cross-members 15–18, and lower horizonal member 33 each have a plurality of upwardly-facing slots 139. Each lower cover panel 5 includes a plurality of downwardly-extending fingers 266 which are formed of substantially flat metal. Fingers 266 are inserted into slots 139 to retain the lower edge 267 of lower cover panel 5 to the frame 3. Horizontal cross members 14–18 each include a plurality of clip-receiving slots 269 (see also FIG. 11) that are spaced below the horizontal rows of slots 21. A plurality of clips 270 along the upper edge 271 of each cover panel 5 are received in the slots 269 to retain the lower cover panels 5 on the frame 3. During installation, the fingers or extensions 266 are inserted into the slots 139, of the selected horizontal cross-member, and the upper edge 271 of a selected cover panel 5 is rotated inwardly to engage the clips 270 into slots 269.

With reference to FIGS. 38–40, each lower cover panel 5 includes a downwardly-extending upper flange 272, and an upwardly-extending lower flange 273. As described in more detail in above-referenced co-pending U.S. patent application Ser. No. 09/005,428, entitled "PARTITION SYSTEM WITH REMOVABLE COVER PANELS," clips 270 are removably attached to the flange 272 along lower edge 274 thereof. Fingers 266 are rotatably mounted to the lower flange 273 at 275. Fingers 266 can be rotated about the pivot point 275 to provide clearance to the horizontal row of slots 22 in the lower frame cross member 33 if required for supporting hang-on accessory units. As best seen in FIG. 41, clip 270 has a V-shape with upper leg 276 and lower leg 277. Legs 276 and 277 flex inwardly toward one another upon insertion of clip 270 into slots 269, and flex outwardly when in the fully-installed position illustrated in FIG. 41. In this position, the edge 278 of leg 270 abuts the inner surface of upper horizontal cross member 14, thereby retaining the cover panel 5 to the frame 3. As discussed above, the reconfigurable office partition of the present invention can be interconnected with partial-height partition systems to provide various levels of user interaction, depending on the user's tasks and responsibilities. The lower cover panels 5 are interchangeable with partial-height partition systems, thereby providing an integrated appearance, while simultaneously increasing the reconfigurability, and reducing the number of different cover panels that must be manufactured.

Figure 42:
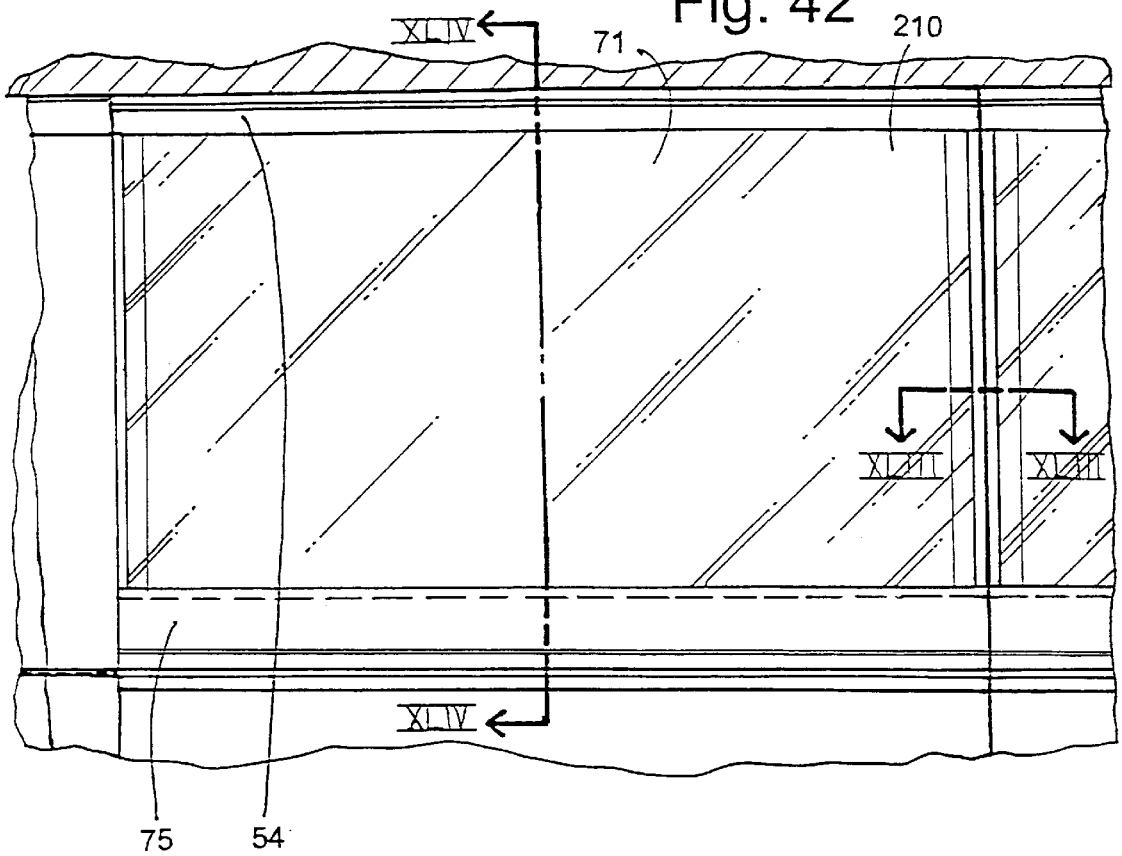
FIG. 42 is a fragmentary, front elevational view of a glass module.
Figure 44:
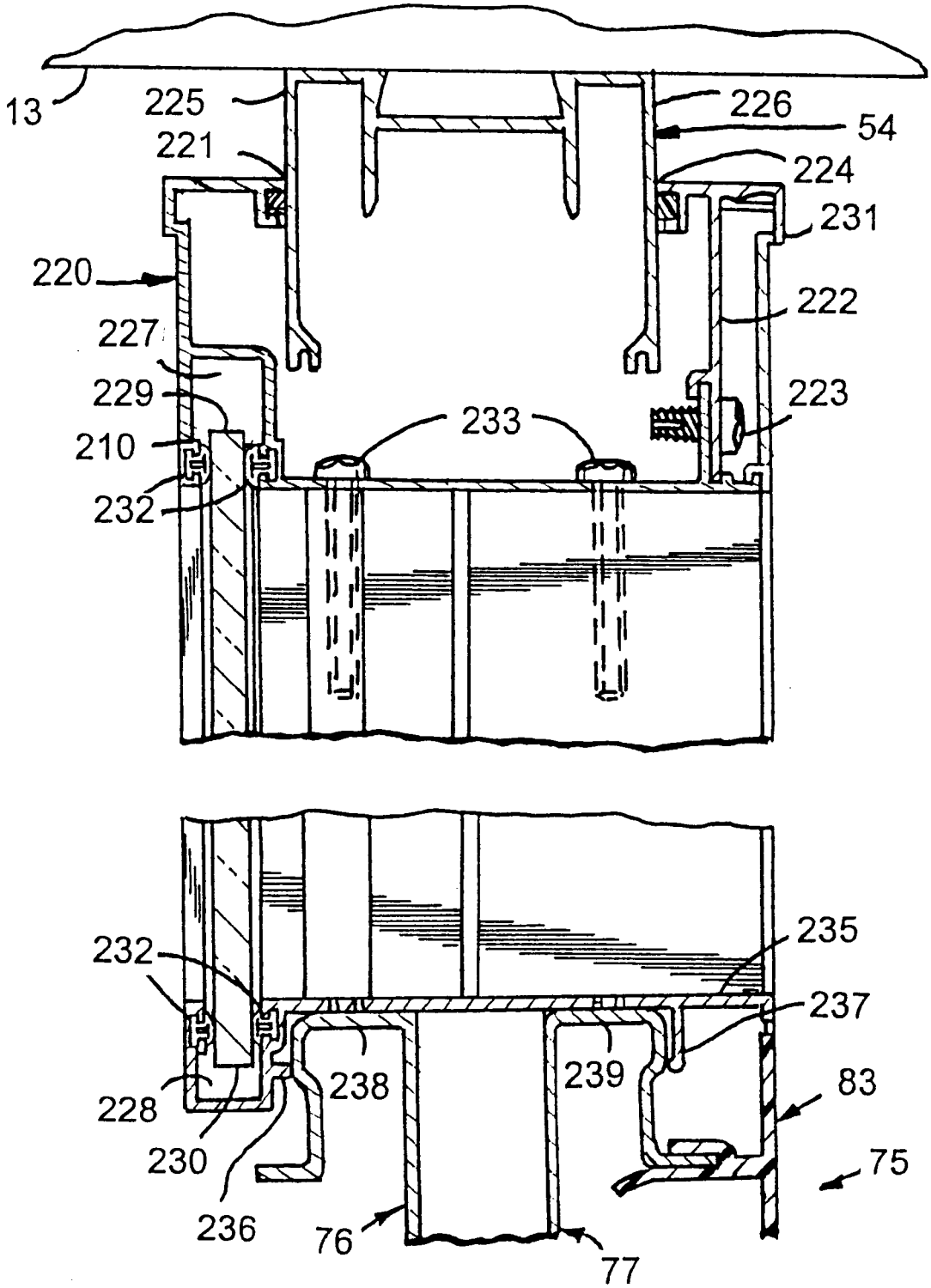
FIG. 44 is a fragmentary, cross-sectional view of a glass module taken along the line XLIV—XLIV FIG. 42.

As illustrated in FIGS. 42–44, the upper portion of the panel 2 may include a glass module 71 extending between the ceiling track 54 and the expressway 75, and also covering the C-shaped stanchion 50, the G-shaped structural extension 51, and upper bracket 53 of the variable height support 12. As described in more detail in above-referenced co-pending U.S. patent application Ser. No. 09/038,370, entitled "OVERHEAD STRUCTURES FOR WALL SYSTEM," glass module 71 includes a transparent sheet such as glass sheet 210. A pair of vertical side members 211 (FIG. 43) extend upwardly around the C-shaped stanchion 50 and structural extension 51, and include a channel 212 along a forward side which removably receives a retainer strip 213. A rear cover 214 clips or snaps onto the vertical side members 211 at 215 such that the vertical side members 211 and the rear cover 214 are retained on the structural extension 51 at 216 and 217. Structural extensions 50 may include an indented portion 218 which receives a resilient, compressible strip 219 to provide an acoustic and/or light seal between adjacent glass modules 71. Glass module 71 is supported by the expressway 75 along a lower edge, and the ceiling track 54 along an upper edge such that it is not necessary to interconnect adjacent glass modules 71 along the side edges thereof.

With reference to FIG. 44, resilient member 221 of upper horizontal member 220 abuts the first side face 225 of ceiling track 54. Retainer 222 is fastened to the upper horizontal member 220 by fasteners 223 and abuts the opposite side face 226 of ceiling track 54 at resilient member 224 to thereby secure the upper edge of glass module 71 to the ceiling track 54. Rear trim piece 231 snaps over the retainer 222 to provide a uniform appearance that is consistent with the horizontal frame member 220. The upper edge 229 of glass sheet 210 is received in upper pocket 227 between resilient members 232, and the lower edge 230 of glass sheet 210 is received between resilient members 232 of lower pocket 228. Fasteners 233 are received in screw bosses 234 (FIG. 43) of vertical side members 211 to secure horizontal member 220 to the vertical members 211. A lower horizontal member 235 (FIG. 44) includes downwardly-extending front and rear portions 236 and 237 which fit over the upper portions 238 and 239 of channels 76 and 77 to retain the lower edge of the glass module 71 to the expressway 75.

Figure 45:
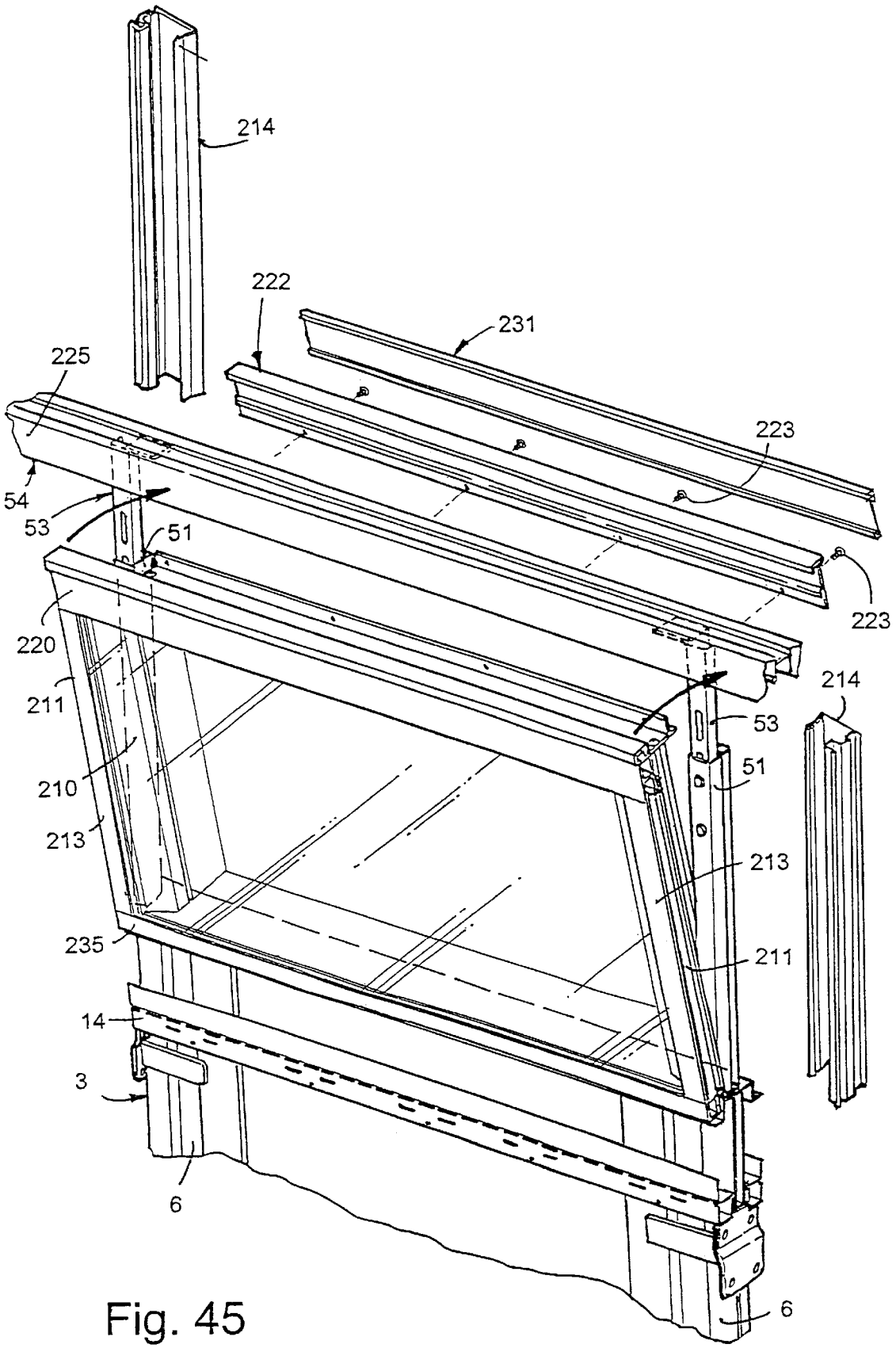
FIG. 45 is a fragmentary, exploded perspective view of a glass module during installation.

With reference to FIG. 45, during assembly of glass module 71, upper and lower horizontal members 220 and 235 are secured to the vertical members 211 with glass sheet 210 being received in upper and lower pockets 227 and 228. Retainers 213 are then snapped into the channels 212 in vertical side members 211. The lower member 235 is then placed onto channels 276 and 277 and rotated inwardly until the resilient strip 221 along the upper edge contacts the side face 225 of ceiling track 54. Fasteners 223 are then installed to secure retainer 222, and cover 231 is snapped onto the retainer 222. The rear covers 214 are then snapped onto the vertical members 211, thereby covering the stanchions 50, structural extensions 51, and upper bracket 53 of the variable height support 12.

During installation of the panel 2, the floor track 30 and ceiling track 54 are first secured to the floor and ceiling, respectively. If required, structural extensions 51 are cut to the required length to account for the floor-to-ceiling height of the office space being divided. The panel frame 3 is then placed onto the floor track 30, and structural extensions 51 and brackets 53 are installed, with the upper brackets 53 being fastened to the ceiling track 54. With reference to FIG. 20, the frames 3 of adjacent panels are aligned, and fasteners 155 are inserted through the adjacent connector brackets 40 and 41 to thereby secure the adjacent panels to one another. During assembly, the fasteners 56 (FIG. 9), in conjunction with slot 55 and bracket 53, are used to provide additional vertical adjustment of the variable height support 12. Jack screws 32 are then used to level the frame, and fasteners 56 are secured when the frame 3 is in the level condition at the desired height. Lower cover panels 5 are then installed to the frame 3, and an upper cover panel 250 or 451 is then installed as described above. Alternatively, a glass module 71 may be assembled and installed as also described above.

The panel 2 can be moved by removing the cover panels 5, and disconnecting the upper cover panel 250 or 451. Alternatively, the glass module 71 can be removed by disassembling covers 214, rear trim 231 and retainer 222. The glass module frame assembly 210 is then rotated outwardly, and lifted upwardly from the panel. Upper bracket 53 may then be disconnected from the ceiling track 54, and the panel frame 3 is removed. Floor and ceiling tracks 30 and 54 can then be removed, and reinstalled in the new location in the manner described above.

Accordingly, the reconfigurable office partition of the present invention provides a floor-to-ceiling wall partition having sound insulating and appearance characteristics suitable for private office spaces and the like, yet permitting the panel system to be easily reconfigured and moved.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

The invention claimed is:

1. In a frame for reconfigurable office partitions and the like, the improvement comprising:

at least one rigid stile disposed in a normally vertical orientation, and including first and second channels extending longitudinally therealong and being shaped to receive utilities therein through outwardly opening sides; said outwardly opening sides of said first and second channels being juxtaposed in opposite directions to facilitate routing utilities therein along opposite faces of said frame, at least a portion of each outwardly opening side being unobstructed; said first and second channels each defining an unobstructed open upper end to permit unimpeded vertical routing of utility lines through said open upper ends; and at least one vertically extending utility line disposed within a selected one of said first and second channels.

2. A partition frame as set forth in claim 1, wherein:

said first and second channels are positioned in a side-by-side relationship.

3. A partition frame as set forth in claim 2, wherein:

said stile includes a side wall common to and separating said first and second channels.

4. A partition frame as set forth in claim 3, wherein:

said first and second channels have a substantially identical configuration to receive similar utilities therein.

5. A partition frame as set forth in claim 4, wherein:

said stile extends along one side of said frame.

6. A partition frame as set forth in claim 5, including:

first and second ones of said stiles extending along opposite sides of said frame.

7. A partition frame as set forth in claim 6, wherein:

said first and second stiles each include an inwardly projecting mounting flange defining a pocket therebetween adapted to receive a core panel therein.

8. A partition frame as set forth in claim 7, including:

a top cross-member disposed in a normally horizontal orientation, and extending between and connected to said first and second stiles.

9. A partition frame as set forth in claim 8, including:

a bottom cross-member disposed in a normally horizontal orientation, and extending between and connected to said first and second stiles.

10. A partition frame as set forth in claim 9, in combination with a core panel mounted in said pocket, and having a solid interior construction providing a sound barrier.

11. A partition frame as set forth in claim 10, in combination with at least one cover panel detachably mounted on said frame, and enclosing at least a portion of opposite faces of said frame.

12. A partition frame as set forth in claim 11, in combination with a floor track shaped to be supported along a floor surface, and in combination with a ceiling track shaped to be supported along a ceiling surface; and wherein said frame is prefabricated and supported between said floor track and said ceiling track with a base portion operably connected with said floor track and a top portion spaced vertically apart from said ceiling track.

13. A partition frame as set forth in claim 1, including:

first and second ones of said stiles extending along opposite sides of said frame, said stiles each including an inwardly projecting flange defining a pocket therebetween adapted to receive a core panel therein.

14. A partition frame as set forth in claim 1, in combination with a floor track shaped to be supported along a floor surface, and in combination with a ceiling track shaped to be supported along a ceiling surface; and wherein said frame is supported between said floor track and said ceiling track with a base portion operably connected with said floor track and a top portion spaced vertically apart from said ceiling track.

15. In a partition frame for reconfigurable office partitions and the like, the improvement comprising:

at least one rigid stile disposed in a normally vertical orientation, and including first and second channels extending longitudinally therealong and being shaped to receive utilities therein through outwardly opening sides; said outwardly opening sides of said first and second channels being juxtaposed in opposite directions to facilitate routing utilities therein along opposite faces of said frame; said first and second channels positioned in a side-by-side relationship; said stile including a side wall common to and separating said first and second channels; said first and second channels having a substantially identical configuration to receive similar utilities therein; first and second ones of said stiles extending along opposite sides of said frame; said first and second stiles each including an inwardly projecting mounting flange defining a pocket therebetween adapted to receive a core panel therein;

a top cross-member disposed in a normally horizontal orientation, and extending between and connected to said first and second stiles;

a bottom cross-member disposed in a normally horizontal orientation, and extending between and connected to said first and second stiles;

a core panel mounted in said pocket, and having a solid interior construction providing a sound barrier;

at least one cover panel detachably mounted on said frame, and enclosing at least a portion of opposite faces of said frame; and a floor track shaped to be supported along a floor surface, and in combination with a ceiling track shaped to be supported along a ceiling surface; and wherein said frame is prefabricated and supported between said floor track and said ceiling track with a base portion operably connected with said floor track and a top portion spaced vertically apart from said ceiling track; and a variable height panel support extending between and connected with said frame top portion and said ceiling track; said variable height panel support being vertically adjustable and including a lock which rigidly retains said panel support at a selected height.

16. A partition frame as set forth in claim 15, wherein:

said frame includes a plurality of connectors shaped to detachably interconnect said frame to a substantially identical adjacent frame in a side-by-side relationship.

17. A partition frame as set forth in claim 16, wherein:

said core panel comprises sheet metal.

18. A partition frame as set forth in claim 16, wherein:

said core panel comprises a gypsum sheet.

19. In a partition frame for reconfigurable office positions and the like, the improvement comprising:

at least one rigid stile disposed in a normally vertical orientation, and including first and second channels extending longitudinally therealong and being shaped to receive utilities therein through outwardly opening sides; said outwardly opening sides of said first and second channels being juxtaposed in opposite directions to facilitate routing utilities therein along opposite faces of said frame; and a variable height panel support mounted on an upper portion of said frame, said variable height panel support being vertically extensible, and including a lock which rigidly retains said variable height panel support at a selected height.

20. A movable panel system for reconfigurable office partitions and the like, comprising:

a base shaped to be supported along a floor surface;

a top shaped to be supported along a ceiling surface;

a plurality of prefabricated, rigid frames, each supported between said base and said top, and including at least two rigidly interconnected stiles disposed in a normally vertical orientation, and extending along opposite sides thereof, to define a pocket therebetween, and a core panel mounted in said pocket; said core panel having a solid interior construction providing a sound barrier, and said stiles each including at least one channel extending longitudinally therealong shaped to receive utilities therein through outwardly opening sides, said frames disposed side-by-side and rigidly interconnected along opposite sides to form joints, said frames forming a partition, with adjacent pairs of said stiles of adjacent frames positioned side-by-side at said joints; and at least one cover panel detachably mounted on each said frame, and enclosing at least a portion of opposite faces of each said panel.

21. A movable panel system as set forth in claim 20, including:

at least two cross-members extending between and connected to said stiles in a vertically spaced apart relationship.

22. A movable panel system as set forth in claim 21, wherein:

said channel comprises a first channel; and said stiles each include a second channel extending longitudinally therealong in a side-by-side relationship, said second channel being shaped to receive utilities therein through an outwardly-opening side; said outwardly-opening sides of said first and second channels being juxtaposed in opposite directions to facilitate routing utilities therein along opposite faces of said frame.

23. A movable panel system as set forth in claim 20, wherein:

said core panel comprises a gypsum sheet.

24. A movable panel system as set forth in claim 20, wherein:

said base comprises a floor track having an upwardly-extending flange that extensibly engages the base portion of said frame to provide an acoustic barrier.

25. A movable panel for reconfigurable office partitions and the like, comprising:

a base shaped to be supported along a floor surface;

a top shaped to be supported along a ceiling surface;

a prefabricated, rigid frame, supported between said base and said top, and including at least two rigidly interconnected stiles disposed in a normally vertical orientation, and extending along opposite sides thereof, to define a pocket therebetween, and a core panel mounted in said pocket; said core panel having a solid interior construction providing a sound barrier, and said stiles each including at least one channel extending longitudinally therealong shaped to receive utilities therein through outwardly opening sides;

at least one cover panel detachably mounted on said frame, and enclosing at least a portion of opposite faces of said panel;

at least two cross-members extending between and connected to said stiles in a vertically spaced apart relationship;

said channel comprising a first channel; and said stiles each including a second channel extending longitudinally therealong in a side-by-side relationship, said second channel being shaped to receive utilities therein through an outwardly-opening side; said outwardly-opening sides of said first and second channels being juxtaposed in opposite directions to facilitate routing utilities therein along opposite faces of said frame; and a variable height panel support extending between and connected with an upper portion of said frame and said top; said upper portion of said frame being spaced vertically apart from said top; said variable height panel support being vertically adjustable and including a lock which rigidly retains said variable height panel support at a selected height.

26. A movable panel as set forth in claim 25, wherein:

said frame includes a plurality of connectors shaped to detachably interconnect said frame to a substantially identical adjacent frame in a side-by-side relationship.

27. A movable panel as set forth in claim 26, wherein:

said stiles each include a sidewall common to and separating said first and second channels.

28. A movable panel as set forth in claim 27, wherein:

said first and second channels have a substantially identical configuration to receive similar utilities therein.

29. A movable panel for reconfigurable office partitions and the like, comprising:

a base shaped to be supported along a floor surface;

a top shaped to be supported along a ceiling surface;

a prefabricated, rigid frame, supported between said base and said top, and including at least two rigidly interconnected stiles disposed in a normally vertical orientation, and extending along opposite sides thereof, to define a pocket therebetween, and a core panel mounted in said pocket; said core panel having a solid interior construction providing a sound barrier, and said stiles each including at least one channel extending longitudinally therealong shaped to receive utilities therein through outwardly opening sides;

at least one cover panel detachably mounted on said frame, and enclosing at least a portion of opposite faces of said panel; and wherein said core comprises sheet metal.

30. In a movable partition panel of the type having a bottom, a top, opposite first and second faces, and opposite sides adapted for detachable connection with like panels, the improvement comprising:

a first channel extending continuously from said bottom to said top in a normally vertical orientation defined by a closed rear side wall shaped to receive utilities therein with an open outwardly oriented side through which utilities are inserted into said first channel;

a second channel extending continuously from said bottom to said top in a normally vertical orientation defined by a closed rear side wall shaped to receive utilities therein with an open outwardly oriented side through which utilities are inserted into said second channel; and wherein said first and second channels are oriented in opposite directions, such that said first channel opens toward said first face, and said second channel opens toward said second face thereby permitting utilities to be routed vertically along both faces of said panel, said first and second channels positioned adjacent a selected opposite side.

31. A movable partition panel as set forth in claim 30, wherein:

said first and second channels are positioned in a side-by-side relationship.

32. A movable partition panel as set forth in claim 31, wherein:

said panel includes a sidewall common to and separating said first and second channels.

33. A movable partition panel as set forth in claim 32, wherein:

said first and second channels have a substantially identical configuration to receive similar utilities therein.

34. A movable partition panel as set forth in claim 33, including:

a panel frame having first and second stiles extending along opposite sides of said frame.

35. In a movable partition panel of the type having a bottom, a top, opposite first and second faces, and opposite sides adapted for detachable connection with like panels, the improvement comprising:

a first channel extending continuously from said bottom to said top in a normally vertical orientation defined by a closed rear side wall shaped to receive utilities therein with an open outwardly oriented side through which utilities are inserted into said first channel;

a second channel extending continuously from said bottom to said top in a normally vertical orientation defined by a closed rear side wall shaped to receive utilities therein with an open outwardly oriented side through which utilities are inserted into said second channel; and wherein said first and second channels oriented in opposite directions, such that said first channel opens toward said first face, and said second channel opens toward said second face thereby permitting utilities to be routed vertically along both faces of said panel;

said first and second channels positioned in a side-by-side relationship;

said panel includes a sidewall common to and separating said first and second channels;

said first and second channels have a substantially identical configuration to receive similar utilities therein;

said partition panel including a panel frame having first and second stiles extending along opposite sides of said frame; and wherein said first and second channels are disposed in each of said stiles.

36. A movable partition panel as set forth in claim 35, including:

a floor track shaped to be supported on a floor surface;

a ceiling track shaped to be supported on a ceiling surface, and defining between said ceiling track and said floor track a floor-to-ceiling height;

said panel frame being supported in a normally vertical orientation between said floor track and said ceiling track, and having a predetermined height less then said floor-to-ceiling height;

said panel frame having a base portion operably connected with said floor track, and a top portion spaced vertically apart from said ceiling track;

a variable height panel support extending between and connected with said panel frame top portion and said ceiling track; said panel support being vertically extensible and including a lock which rigidly retains said panel support at a selected height.

37. A movable partition panel as set forth in claim 36, including:

at least one cover panel that is retained by at least one of said panel support and said frame and enclosing an associated portion of the same.

38. A movable partition panel as set forth in claim 37, wherein:

said base portion of said panel frame is vertically spaced-apart from said floor track to define a gap therebetween;

said floor track including an upwardly-extending flange extending therealong and extensibly engaging said panel frame to provide an acoustic barrier.

39. A movable partition panel as set forth in claim 38, wherein:

said stiles define a pocket therebetween; and including:

a core panel mounted in said pocket, and having a solid interior construction providing a sound barrier.

40. A stile for reconfigurable partition frames, comprising:

a rigid upright including first and second channels extending longitudinally therealong and being shaped to receive utilities therein through outwardly opening sides; said outwardly opening sides of said first and second channels being juxtaposed in opposite directions to facilitate routing utilities therein along opposite faces of the partition frame, said upright including a vertically extending groove that opens in a transverse direction relative to said opposite directions, said groove shaped to receive an elongated sealer strip to seal joints between adjacent partition frames.

41. A partition stile as set forth in claim 40, wherein:

said first and second channels are positioned in a side-by-side relationship.

42. A partition stile as set forth in claim 41, wherein:

said stile includes a side wall common to and separating said first and second channels.

43. A partition stile as set forth in claim 42, wherein:

said first and second channels have a substantially identical configuration to receive similar utilities therein.

44. A partition stile as set forth in claim 43, including:

an elongated sealer strip; and wherein:

said stile includes an outer flange having said groove extending therealong, said groove receiving said elongated sealer strip to provide a barrier when said stile is disposed adjacent another substantially identical partition stile.

45. A partition stile as set forth in claim 44, wherein:

said sealer strip forms an acoustic barrier to block sound transmission between adjacent offices.

46. A partition stile as set forth in claim 45, wherein:

said stile is formed from sheet metal.

47. A partition stile as set forth in claim 46, wherein:

said stile includes an inwardly projecting mounting flange adapted to receive a core panel.

48. A partition stile as set forth in claim 47, wherein:

said stiles are fabricated by a roll-forming process.

49. A partition stile as set forth in claim 40, wherein:

said first and second channels have a substantially identical configuration to receive similar utilities therein.

50. A reconfigurable office partition system, comprising:

a floor track shaped to be supported along a floor surface;

a ceiling track shaped to be supported along a ceiling surface;

a plurality of prefabricated, rigid frames, supported between said floor track and said ceiling track, each including:

at least two stiles disposed in a normally vertical orientation, and extending along opposite sides thereof; said stiles each including at least one channel extending longitudinally therealong and being shaped to receive utilities therein through outwardly opening sides; said stiles defining a pocket therebetween;

a core panel mounted in said pocket, and having a solid interior construction providing a sound barrier;

a plurality of connectors detachably interconnecting said frames in a side-by-side relationship; and a plurality of cover panels detachably mounted on said frames, and enclosing opposite faces of said panels.

51. A reconfigurable office partition system as set forth in claim 50, wherein:

each of said frames includes a variable height panel support connected with a top portion of an associated one of said frames and extending to and connected with said ceiling track; said panel support being vertically extensible and including a lock which rigidly retains said panel support at a selected height.

52. A reconfigurable office partition system as set forth in claim 51, wherein:

each of said frames includes at least two cross-members extending between and connected to said stiles in a vertically spaced-apart relationship.

53. A reconfigurable office partition system as set forth in claim 52, wherein:

said floor track includes an upwardly-extending flange forming an acoustic barrier.

54. A reconfigurable office partition system as set forth in claim 53, wherein:

said at least one channel comprises a first channel; and said stiles each include a second channel extending longitudinally therealong and being shaped to receive utilities therein through an outwardly-opening side; said outwardly-opening sides of said first and second channels being juxtaposed in opposite directions to facilitate routing utilities therein along opposite faces of said frames.

55. A reconfigurable office partition system as set forth in claim 54, wherein:

said first and second channels are positioned in a side-by-side relationship.

56. A reconfigurable office partition system as set forth in claim 55, wherein:

said stile includes a side wall common to and separating said first and second channels.

57. A reconfigurable office partition system as set forth in claim 56, wherein:

said first and second channels have a substantially identical configuration to receive similar utilities therein.

58. A reconfigurable office partition system as set forth in claim 50, wherein:

said core panel comprises a gypsum sheet.

59. A reconfigurable office partition system as set forth in claim 50, wherein:

said core panel comprises sheet metal.

60. A movable panel for reconfiguring floor-to-ceiling office partitions and the like, comprising:

a floor track shaped to be supported on a floor surface;

a ceiling track shaped to be supported on a ceiling surface, and defining between said ceiling track and said floor track a floor-to-ceiling height;

a prefabricated rigid panel frame supported in a normally vertical orientation between said floor track and said ceiling track, and having a predetermined height less than said floor-to-ceiling height; said panel frame having a base portion operably connected with said floor track, and a horizontally extending rigid frame member defining a top side edge of the panel frame; said top side edge spaced vertically apart from said ceiling track to define an upper space between said ceiling track and said top side edge;

a variable height pane support extending between and connected with said panel frame top portion and said ceiling track; said variable height panel support being vertically adjustable and including a lock which rigidly retains said variable height panel support at a selected height;

a lower cover panel detachably connected with at least one of said panel frame and said panel support and enclosing an associated portion of the same, said lower cover having an upper edge adjacent said top side edge; and an upper cover panel vertically juxtaposed above said lower cover panel and closing off said upper space, said upper cover panel having a lower edge vertically adjacent said upper edge of said lower cover panel.

61. A movable panel as set forth in claim 60, wherein:

said panel frame includes at least two stiles disposed in a normally vertical orientation and extending along opposite sides of said panel frame; said stiles each including at least one channel extending longitudinally therealong and being shaped to receive utilities therein through an outwardly-opening side.

62. A movable panel for reconfiguring floor-to-ceiling office partitions and the like, comprising:

a floor track shaped to be supported on a floor surface;

a ceiling track shaped to be supported on a ceiling surface, and defining between said ceiling track and said floor track a floor-to-ceiling height;

a prefabricated rigid panel frame supported in a normally vertical orientation between said floor track and said ceiling track, and having a predetermined height less than said floor-to-ceiling height; said panel frame having a base portion operably connected with said floor track, and a top portion spaced vertically apart from said ceiling track;

a variable height panel support extending between and connected with said panel frame top portion and said ceiling track; said variable height panel support being vertically adjustable and including a lock which rigidly retains said variable height panel support at a selected height;

at least one cover panel detachably connected with at least one of said panel frame and said panel support and enclosing an associated portion of the same;

said panel frame including at least two stiles disposed in a normally vertical orientation and extending along opposite sides of said panel frame; said stiles each including at least one channel extending longitudinally therealong and being shaped to receive utilities therein through an outwardly-opening side;

said panel frame including at least two cross-members extending between and connected to said stiles in a vertically spaced-apart relationship to define with said stiles a pocket therebetween; and a core panel mounted in said pocket, and having a solid interior construction providing a sound barrier.

63. A movable panel as set forth in claim 62, wherein:

said variable height support includes an upwardly-extending structural extension and a bracket extensibly mounted on said structural extension and fixedly secured to said ceiling track.

64. A movable panel as set forth in claim 63, wherein:

said panel frame includes a horizontally-extending raceway disposed at a generally overhead position; said raceway being shaped to receive utilities therein.

65. A movable panel as set forth in claim 64, wherein:

said raceways comprise first and second channels with a wall extending vertically therebetween; said first and second channels being oriented in opposite directions, such that utilities can be routed horizontally along opposite faces of said panels.

66. A movable panel as set forth in claim 65, wherein:

a selected one of said panel frame and said floor track includes a flange extending between said panel frame and said floor track to provide an acoustic barrier.

* * * * *